US012270566B2

(12) United States Patent
Czerwinski et al.

(10) Patent No.: US 12,270,566 B2
(45) Date of Patent: Apr. 8, 2025

(54) SELECTIVELY CLOSABLE VENTILATION OPENING

(71) Applicant: Broan-NuTone LLC, Hartford, WI (US)

(72) Inventors: Matthew J. Czerwinski, Excelsior, MN (US); Richard R. Sinur, West Bend, WI (US); Ryan A. Revers, Hartland, WI (US)

(73) Assignee: Broan-NuTone LLC, Hartford, WI (US)

( * ) Notice: Subject to any disclaimer, the term of this patent is extended or adjusted under 35 U.S.C. 154(b) by 619 days.

(21) Appl. No.: 16/520,551

(22) Filed: Jul. 24, 2019

(65) Prior Publication Data

US 2021/0025619 A1 Jan. 28, 2021

(51) Int. Cl.

| | |
|---|---|
| ***F24F 13/08*** | (2006.01) |
| ***F24F 7/00*** | (2021.01) |
| ***F24F 7/06*** | (2006.01) |
| ***F24F 13/02*** | (2006.01) |
| ***F24F 13/062*** | (2006.01) |
| ***F24F 13/078*** | (2006.01) |

(52) U.S. Cl.

CPC ..... *F24F 13/084* (2013.01); *F24F 13/02* (2013.01); *F24F 13/062* (2013.01); *F24F 13/078* (2013.01); *F24F 2007/0025* (2021.01); *F24F 7/06* (2013.01)

(58) Field of Classification Search

CPC .. F24F 13/084; F24F 13/02; F24F 2007/0025; F24F 7/06

USPC ..... 454/276

See application file for complete search history.

(56) References Cited

U.S. PATENT DOCUMENTS

| | | | | |
|---|---|---|---|---|
| 1,722,825 | A | 7/1929 | Roethel | |
| 2,189,008 | A | 2/1940 | Kurth | |
| 2,278,581 | A * | 4/1942 | Macdougald | F24F 7/007 454/348 |
| 2,562,600 | A | 7/1951 | Cadwell et al. | |
| 3,010,378 | A | 11/1961 | Geocaris | |
| 3,068,341 | A | 12/1962 | Ortiz et al. | |
| 3,326,112 | A | 6/1967 | Sadlow et al. | |
| 3,636,306 | A | 1/1972 | Bumpus | |
| 3,692,977 | A | 9/1972 | Duhamel et al. | |
| 3,785,271 | A | 1/1974 | Joy | |
| 4,142,227 | A | 2/1979 | Aikens | |
| 4,320,696 | A * | 3/1982 | Daniels | F24F 13/10 251/63 |
| 4,630,182 | A | 12/1986 | Moroi | |
| 4,681,024 | A | 7/1987 | Ivey | |
| 5,021,932 | A | 6/1991 | Ivey | |
| 5,443,625 | A | 8/1995 | Schaffhausen | |
| 5,664,872 | A | 9/1997 | Spearman et al. | |
| 5,918,972 | A | 7/1999 | Van Belle | |

(Continued)

OTHER PUBLICATIONS

Canadian Application No. 3,087,393, Office Action mailed Mar. 28, 2024 (6 pages).

*Primary Examiner* — Allen R. B. Schult

(74) *Attorney, Agent, or Firm* — Barnes & Thornburg LLP

(57) ABSTRACT

A ventilation assembly having a moveable trim moveable between an open position in which the moveable trim defines a gap with a ceiling trim to allow movement of fluid and a closed position in which the moveable trim is against or adjacent to the ceiling trim to eliminate or reduce the gap and prevent or limit fluid flow.

25 Claims, 19 Drawing Sheets

(56) References Cited

U.S. PATENT DOCUMENTS

| | | | | |
|---|---|---|---|---|
| 5,934,783 | A | 8/1999 | Yoshikawa | |
| 6,095,671 | A | 8/2000 | Hutain | |
| 6,203,421 | B1 * | 3/2001 | Black | F24F 13/06 454/194 |
| 6,340,237 | B1 | 1/2002 | Koga et al. | |
| 6,350,196 | B1 * | 2/2002 | Mott | A61L 9/12 454/337 |
| 6,498,423 | B1 | 12/2002 | Bell et al. | |
| 6,632,006 | B1 | 10/2003 | Rippel et al. | |
| 7,175,309 | B2 | 2/2007 | Craw et al. | |
| 7,455,432 | B2 | 11/2008 | Craw et al. | |
| 8,434,916 | B2 | 5/2013 | Craw et al. | |
| 9,022,622 | B2 | 5/2015 | Craw et al. | |
| 2011/0275306 | A1 * | 11/2011 | Kim | F24F 13/062 454/339 |
| 2019/0113221 | A1 * | 4/2019 | Huang | F04D 29/005 |

* cited by examiner

SELECTIVELY CLOSABLE VENTILATION OPENING

TECHNICAL FIELD

The present disclosure relates to devices, systems, and methods for ventilation. More particularly, but not exclusively, the present disclosure relates to devices, systems, and methods for ventilation of enclosed rooms, and selectively opening and closing a ventilation opening for same.

BACKGROUND

Ventilation is commonly applied to remove undesirable air conditions within confined spaces. For example, common households may include ventilation devices and/or systems for rooms having sinks or bath fixtures that use water to remove excess humidity from the room. Yet, space for other fixtures, such as light fixtures, may be limited, particularly in bathroom areas. Moreover, it may be unnecessary and/or undesirable to maintain ventilation features as visible at all times. Accordingly, there is a need for improved ventilation equipment.

SUMMARY

In accordance with an aspect of the present disclosure, a ventilation assembly comprising a main housing and a trim assembly moveable between an open position, which defines an opening through which fluid may flow from an adjacent room, and a closed position in which the opening is closed.

In accordance with another aspect of the present disclosure, a ventilation assembly may comprise a main housing including an inlet through which air can be received into the main housing and an outlet through which air exits the main housing, a blower situated in the main housing and operable to generate a flow of air, a trim assembly coupled with the main housing and comprising a moveable trim. The trim assembly may be movable between a retracted position in which the moveable trim is near the main housing and an extended position in which the moveable trim is farther from the main housing than in the retracted position.

In some embodiments, the main housing may include a ceiling trim, wherein in the retracted position the moveable trim is positioned near to the ceiling trim and in the extended position the baffle trim is positioned spaced apart from the ceiling trim to define a gap through which air can be drawn into the inlet of the main housing. The trim assembly may include a baffle wall connected with the trim for movement between the retracted and extended positions.

In some embodiments, the baffle wall may form a canister housing for receiving a lighting element for illumination. The canister housing may be formed as a frusto coned-shaped housing defining a space therein for receiving the lighting element, the housing defining an opening that faces away from the main housing for guiding illumination into a room.

In some embodiments, the assembly may include a linkage coupled between a frame secured with the main housing and the trim assembly, the linkage configured to transmit force from an actuator to move the trim assembly in at least one direction between the retracted and extended positions. The frame may include at least one brace coupled with the main housing and configured to guide the trim assembly between the retracted and extended positions. The at least one brace may define a track and the linkage may include a follower arranged within the track and coupled with the trim assembly to guide the moveable trim between the retracted and extended positions.

In some embodiments, the linkage may include at least one guide rod coupled with the at least one brace and coupled with the trim assembly to guide the trim assembly between the retracted and extended positions. The linkage may include at least one of a cam and an inclined plane for operation by an actuator to move the moveable trim.

In some embodiments, the assembly may include an actuator coupled with the frame and configured to provide force to operate the means for moving the trim. The assembly may include at least one spring for biasing the trim assembly in the direction of one of the retracted and extended positions.

In some embodiments, the main housing may be configured for arrangement within an unfinished area of the room. The moveable trim may be configured for arrangement in a finished area of the room that is separated from the unfinished area of the room.

In some embodiments, the trim assembly may comprise a perimeter wall extending from an upper end and a lower end. The trim assembly may comprise a lighting element located adjacent to a perimeter wall upper end and operable to generate light toward and through the perimeter wall lower end. The moveable trim may extend from the perimeter wall lower end.

In some embodiments, the trim assembly may be configured to be located in an aperture in a ceiling such that the moveable trim is located adjacent the ceiling in retracted position and spaced from the ceiling in the extended position. The trim assembly may be configured to be located in an aperture in a ceiling, wherein space is left between the baffle assembly and the ceiling aperture when the trim assembly is in the extended position and the blower is operable to draw air through the ceiling aperture. In some embodiments, the trim assembly is configured to be located in an aperture in a ceiling and the moveable trim is located adjacent the ceiling in the retracted position to limit or prohibit movement of air through the ceiling aperture. The assembly may include a ceiling trim arranged at the edge of the ceiling aperture.

According to another aspect of the present disclosure, a ventilation assembly may comprise a main housing including an inlet through which air can be received into the main housing and an outlet through which air exits the main housing, a blower situated in the main housing and operable to generate a flow of air, and a moveable trim movable between a retracted position in which the moveable trim is near the main housing and an extended position in which the moveable trim is farther from the main housing than in the retracted position to permit fluid flow.

Accordingly to another aspect of the present disclosure, a ventilation assembly configured to be installed in a ceiling of a structure may comprise a main housing including an inlet through which air can be received into the main housing and an outlet through which air exits the main housing, a blower situated in the main housing and operable to generate a flow of air, a ceiling trim configured to be located in an aperture in the ceiling, and a moveable trim movable between a retracted position in which the moveable trim is adjacent to the ceiling trim to limit fluid flow through the ceiling aperture, and an extended position in which the moveable trim is spaced farther from the main housing than in the retracted position to define a gap allowing fluid to flow through the ceiling aperture.

The foregoing and other features of the present disclosure will become more apparent upon reading of the following non-restrictive description of examples of implementation thereof, given by way of illustration only with reference to the accompanying drawings.

BRIEF DESCRIPTION OF THE DRAWINGS

In the appended drawings, where like reference numerals denote like elements throughout and in where.

DETAILED DESCRIPTION

Ventilation assemblies, such as ventilation fan assemblies, are commonly used to ventilate rooms in, residential, commercial, and industrial structures. Ventilation fan assemblies are usually installed in an aperture defined in a ceiling, floor, or wall. Traditional ventilation fan assemblies may include a grille to obscure the aperture and prevent injury from easy access to a blower adjacent the aperture.

Figure 1:
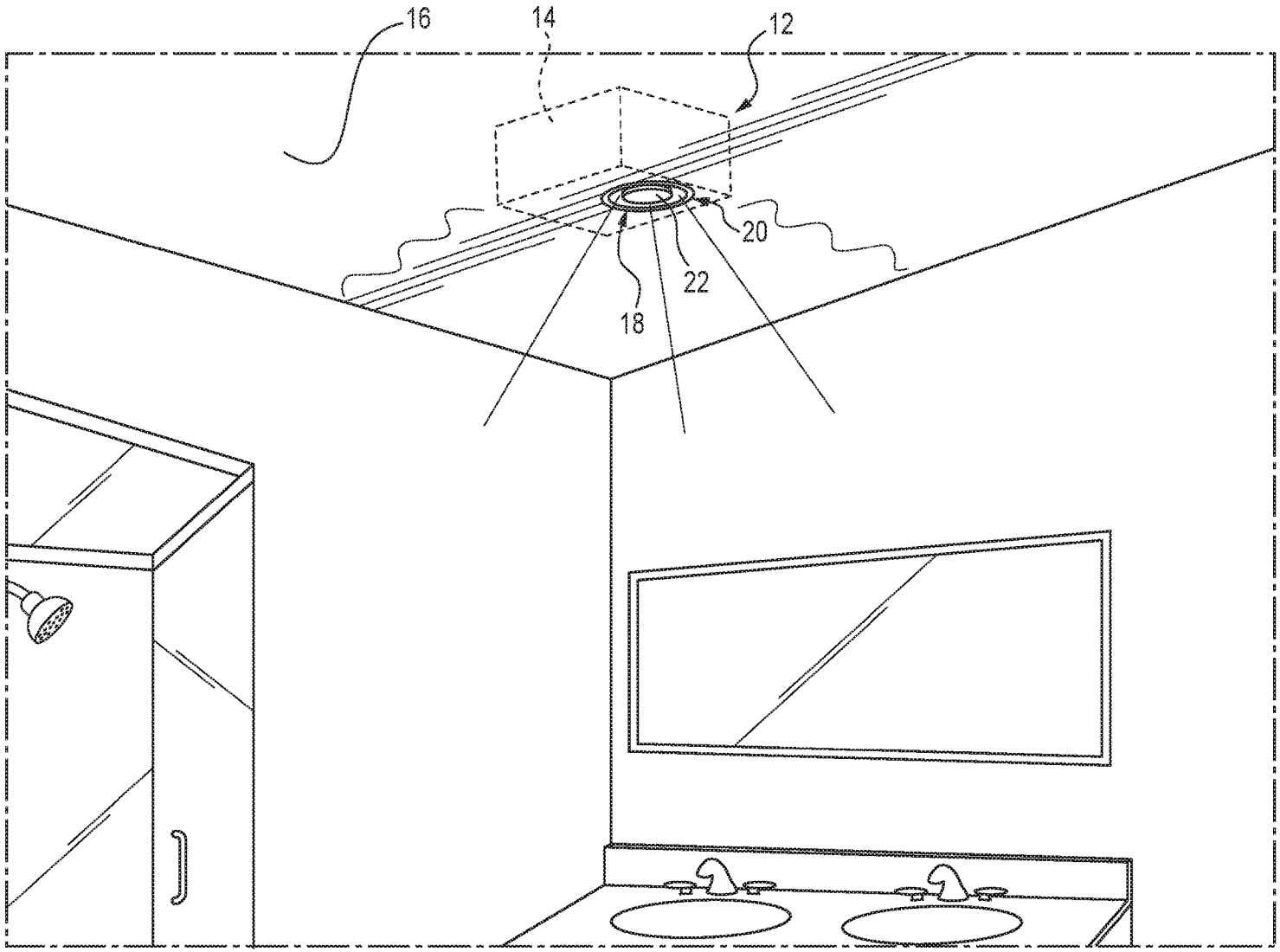
FIG. 1 is a perspective view of a ventilation assembly consistent with the present disclosure, in accordance with a non-restrictive illustrative embodiment thereof, showing the ventilation assembly installed within a bathroom ceiling.

Referring to FIG. 1, an illustrative ventilation assembly 12 is shown installed within a ceiling 16 of a bathroom. The ventilation assembly 12 includes a main housing 14 (as indicated in broken line in FIG. 1) arranged above the ceiling 16 and a moveable trim assembly 18 including a moveable trim 20 shown positioned in close proximity with the 16 of the ceiling. In the depicted embodiment, the trim assembly 18 is formed as a baffle for receiving a lighting element 22, such as a light emitting diode (LED) lighting assembly. The present disclosure also contemplates ventilation assemblies having trim assemblies without a lighting element. The trim assembly 18 is movable between a closed position in which the main housing 14 and the room are not fluidly connected and an extended position which creates and defines a ventilation opening to fluidly connect the main housing and the room to permit the drawing air into the main housing 14 to ventilate the room.

Figure 2A:
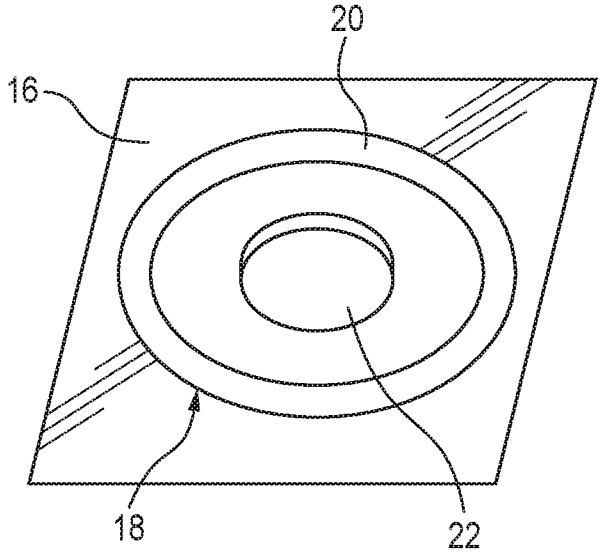
FIG. 2A is a diagrammatic perspective view of the ventilation assembly of FIG. 1 showing a trim arranged in closed position.
Figure 2B:
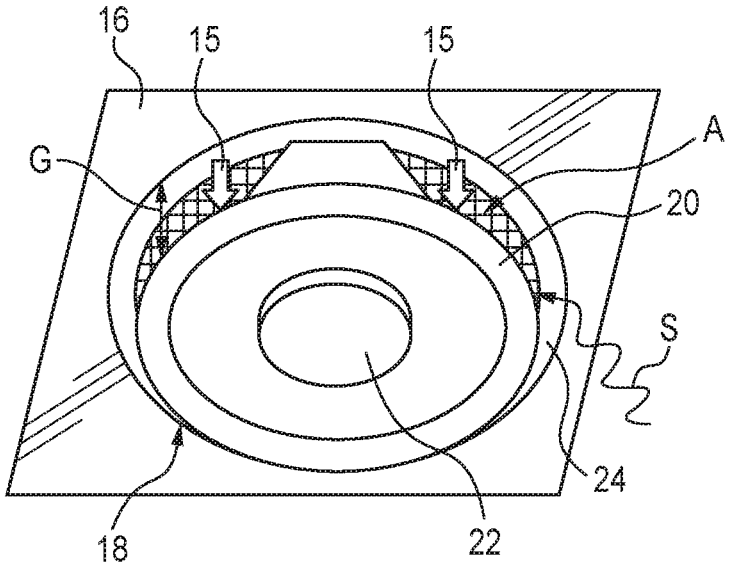
FIG. 2B is the diagrammatic perspective view of the ventilation assembly in FIG. 1 showing the trim arranged in an extended position to define an opening through which air may flow.

Referring now to FIGS. 2A & 2B, the trim assembly 18 is movable between a retracted position as represented in FIG. 2A, and an extended position as represented in FIG. 2B. Although the trim assembly 18 in the depicted exemplary embodiments is shown as a baffle trim of a baffle for lighting element 22, the trim assembly may take any other form consistent with this disclosure to facilitate a closed position in which the main housing 14 is not fluidly connected to the adjacent room and an extended position in which the main housing 14 is fluidly connected to the adjacent room. In the closed position as shown in FIG. 2A, the trim assembly 18 is arranged in a closed configuration. More specifically, in the closed position the moveable trim 20 is arranged close to the surface 16 of the ceiling and contacting a surface of the ceiling 16 or an element interposed between the ceiling 16 and the moveable trim 20, as discussed below.

In the extended position shown in FIG. 2B, the moveable trim 20 has been moved downward as suggested by arrows 15, such that the moveable trim 20 is located farther from the main housing 14, and farther from the ceiling 16 than in the retracted position. In this extended position, the moveable trim 20 defines a gap G between the moveable trim 20 and a ceiling trim 24 that is engaged with the edge of a ceiling aperture A through which the trim assembly 18 extends. In the depicted embodiments, the moveable trim 20 and ceiling trim 24 are annular and create an annular gap G. Other shapes (e.g. square, rectangular, etc.) are, however, within this disclosure. A fluid flow S can be drawn between the through the gap G defined between the moveable trim 20 and the ceiling trim 24 into the main housing 14 through the ceiling aperture A. In the closed position, the gap G defined between the moveable trim 20 and the ceiling trim 24 is eliminated or at least significantly reduced such that the moveable trim 20 can limit or prohibit movement of fluid therethrough. In the closed position, the gap G is either non-existent or smaller and less noticeable than the gap G in the extended position, providing the closed position as a cleaner, sleeker aesthetic appearance.

Figure 3:
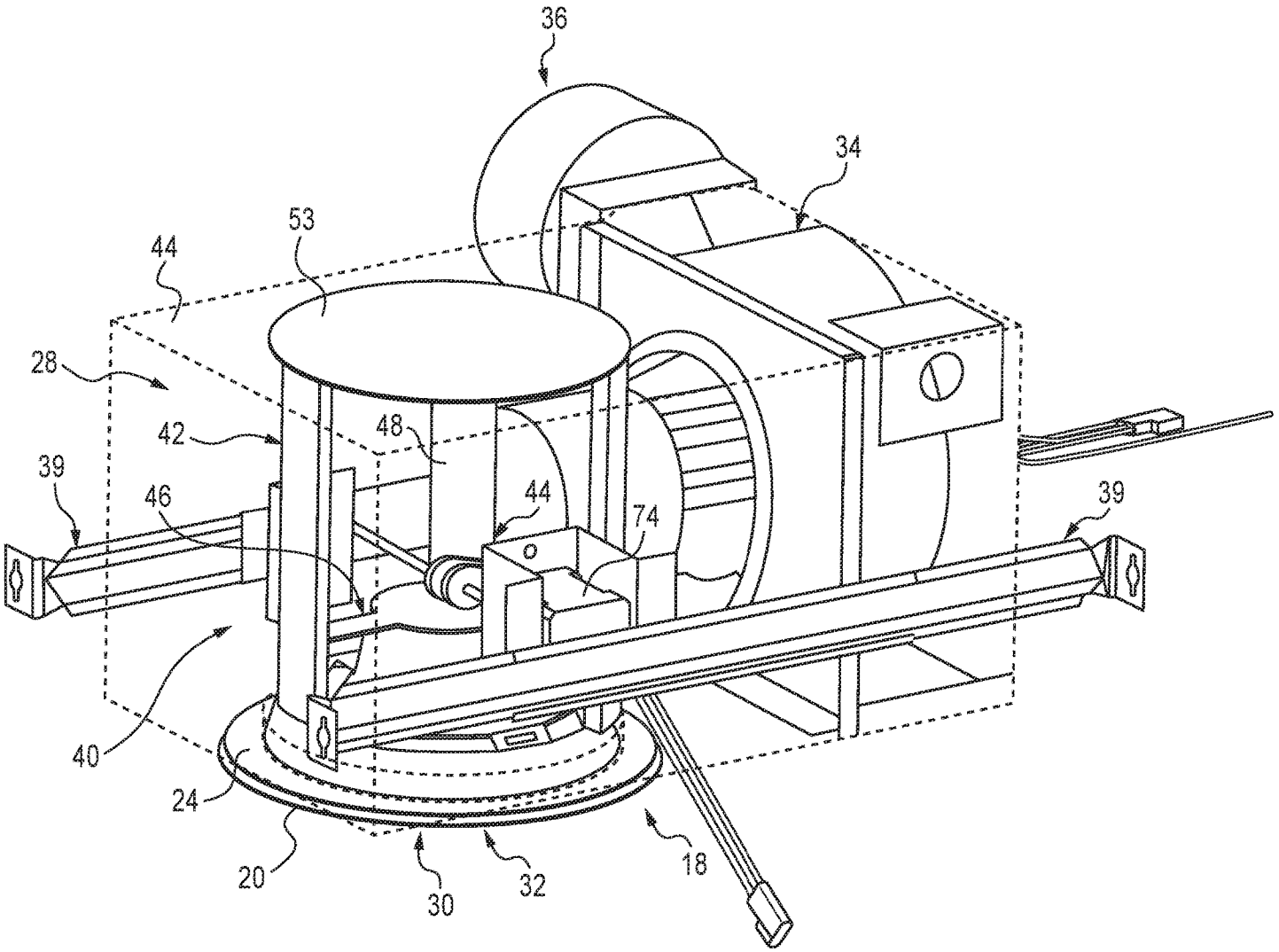
FIG. 3 is a perspective view of a ventilation assembly in accordance with a first non-restrictive illustrative embodiment thereof.

Referring now to FIG. 3, the main housing 14 is shown formed as a box in broken line for descriptive purposes and to facilitate a view of the elements within the main housing 14. The main housing 14 defines a cavity 28 therein having an inlet 30 through which air can be drawn through into the cavity 28, for example, through the ceiling aperture A. A blower 34 is situated within the cavity 28 for operation to generate a flow of air through the main housing 14, illustratively by forced flow of air through an outlet 36 of the main housing 14 and drawing air from the room through the inlet 30 into the cavity 28. The main housing 14 is shown connected to mounting brackets 39 extending longitudinally for connection with a structural support of the room, for example, the ceiling joists.

The ventilation assembly 12 includes an actuation assembly 40 engaged between the main housing 14 and the baffle assembly 18 to selectively move the baffle assembly 18 between the retracted and extended positions. The actuation assembly 40 includes a frame 42 connected with the main housing 14, an actuator assembly 44, and a movable linkage 46 connected with the trim assembly 18 and coupled with the frame 42 for movement under force of the actuator assembly 44 to move the moveable trim 20 between the closed position and the extended position.

Figure 4:
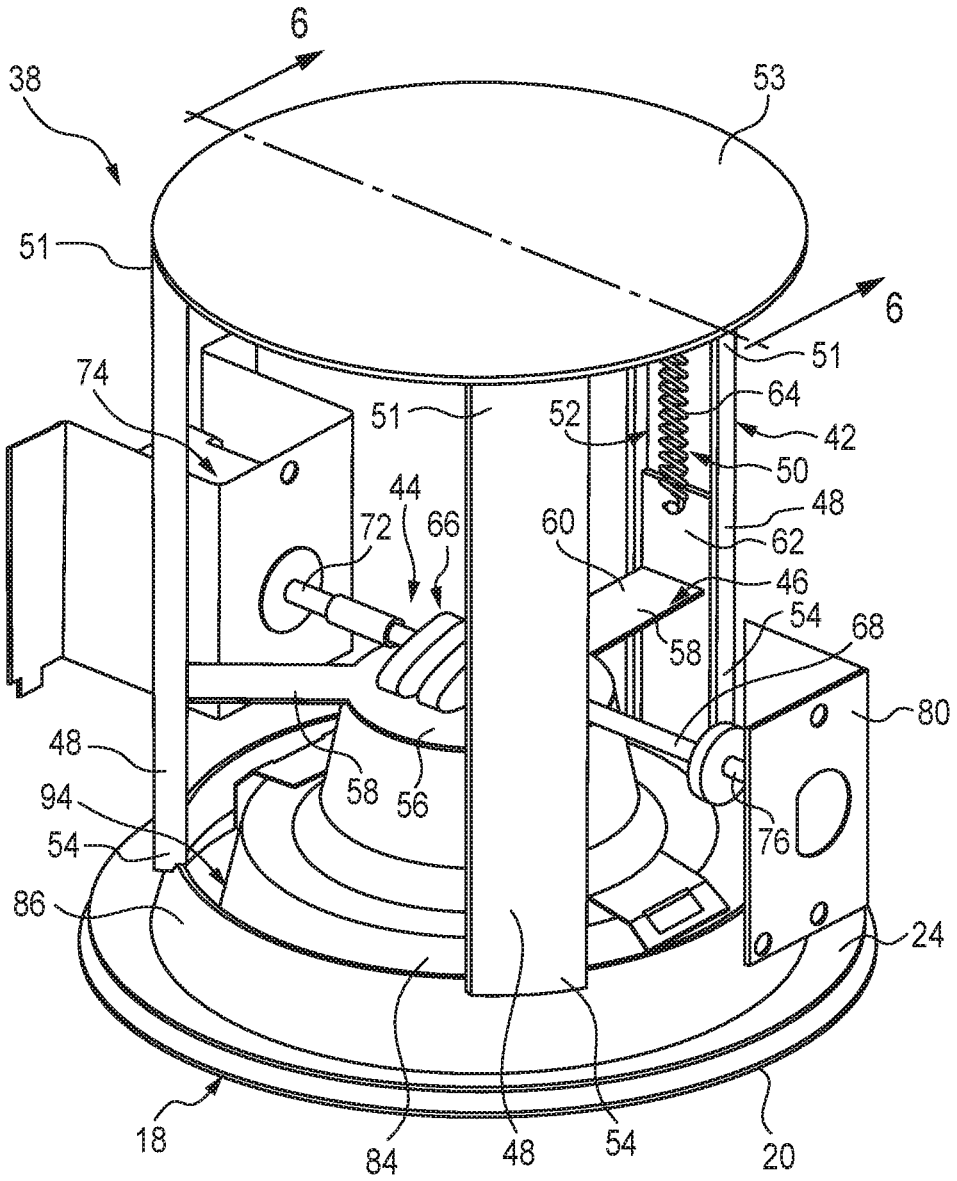
FIG. 4 is another perspective view of a portion of the ventilation assembly of FIG. 3 showing a trim assembly arranged in a closed position.

As shown in FIG. 4, the actuation assembly 40 is shown separated without the main housing 14 for descriptive purposes, along with the trim assembly 18 arranged in the retracted position. The frame 42 includes a number of braces 48 (e.g. three as depicted) each arranged to extend vertically and each having a top end 51 connected with a plate 53 and having a bottom end 54 connected with the ceiling trim 24. Each brace 48 forms a track 50 on an interior side of the brace 48, each track 50 defining a channel 52 extending vertically between the top 51 and bottom 54 ends of the brace 48. The linkage 46 is engaged with the track 50 of each brace 48 for guided vertical movement in the channels 52.

The linkage 46 comprises a linkage plate 56 secured with the trim assembly 18 and configured for engagement with the actuator assembly 44. The linkage plate 56 includes a number of linkage arms 58 corresponding in number to the number of channels 52. The linkage arms 58 each extend outward from the linkage plate 56 to an engagement end 60 for engagement with a corresponding track 50 in the associated channel 52. The linkage 46 includes followers 62 connected at the engagement end 60 of each linkage arm 58 for riding in the associated channel 52.

Each follower 62 is arranged within the channel 52 of the corresponding track 50 for guided engagement with the track 50 during movement of the linkage 46 by the actuator assembly 44. In the illustrative embodiment depicted in FIG. 4, each follower 62 is engaged with one end of a spring 64 and the other end of the spring 64 is engaged with the corresponding brace 48 at the top end 51 near the upper plate 53 to bias the linkage 46 vertically, away from the ceiling trim 24 and towards the upper plate 53. The linkage 46 is connected to the moveable trim 20 of the trim assembly 18, biasing the moveable trim 20 upward against the ceiling trim 24 and, therefore, into the closed position. In some embodiments, any suitable spring arrangement may be provided to bias the linkage 46 upward and thus the moveable trim 20 into the retracted position. In an alternative configuration, the trim assembly 18 may be biased into the extended positions and selectively driven into the retracted position.

Figure 5:
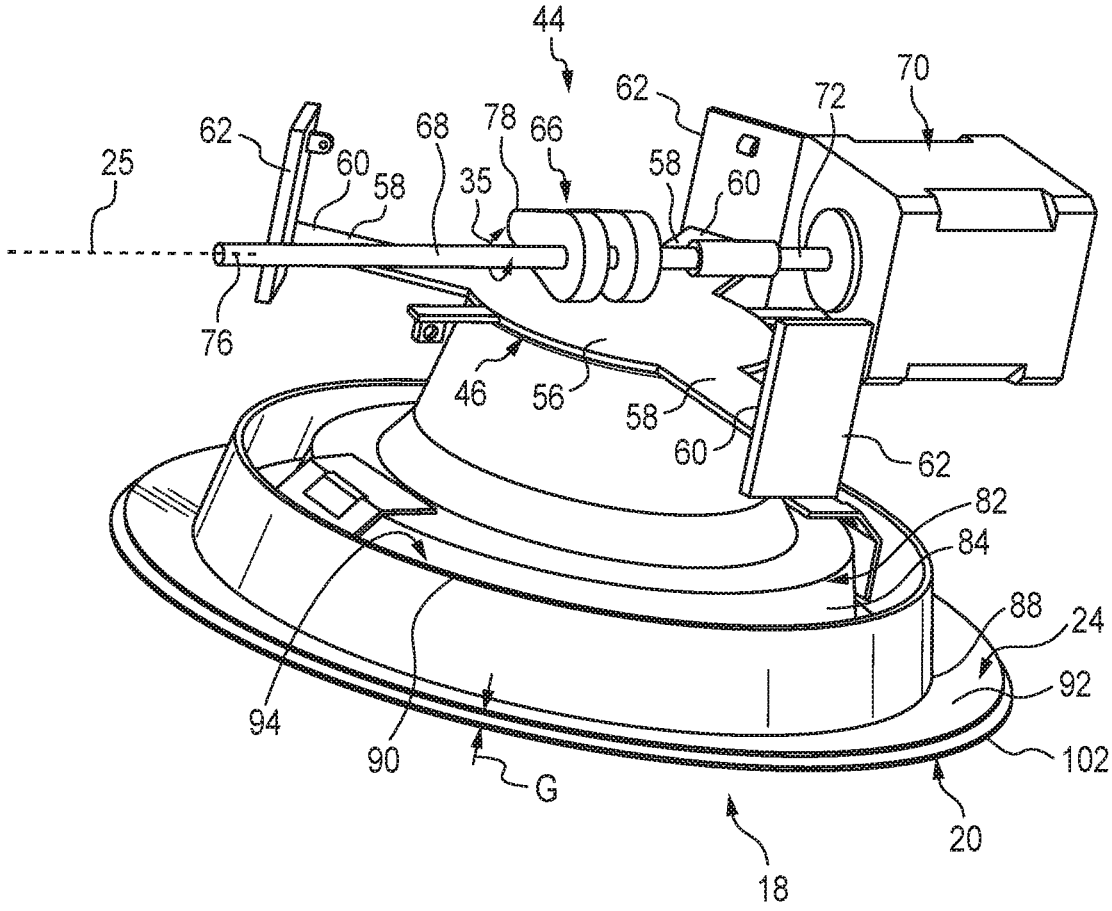
FIG. 5 is perspective view of yet another portion of the ventilation assembly of FIGS. 3 and 4 showing the baffle assembly arranged in the closed position.

Referring now to FIG. 5, the frame 42 has been omitted for descriptive purposes. The followers 62 are embodied as plates formed complimentary with the channels 52 for sliding movement along the vertical extent of motion. The actuator assembly 44 is operable between retract and extend positions to arrange the trim assembly 18 in retracted and extended positions, respectively.

In the depicted embodiment, the actuator assembly 44 include a pair of cams 66 that are rotatable to engage with the linkage plate 56 to drive the linkage 46 downward against the bias of the springs 64, although in some embodiments, any suitable number of cams may be applied. Each cam 66 is fixed for rotation on an actuator shaft 68 to rotate the cams 66 between retract and extend positions. The actuator shaft 68 includes an actuator end 72 engaged with a rotary actuator 70 that selectively rotates the actuator shaft 68 and the cams 66 about the shaft axis 25 as suggested by arrows 35. As explained in additional detail below, an eccentric nose 78 of the cams 66 depresses the linkage plate 56 under rotation of the actuator 70 into the extend position to move the trim assembly 18 into the extended position to create gap G. A brace end 76 of the actuator shaft 68 is rotatably supported by a bracket 80 connected with the main housing 14 as shown in FIGS. 3 and 4.

Referring still to FIG. 5, the trim assembly 18 includes a canister housing 82 having a perimeter wall 84 that is connected with the moveable trim 20 as discussed in additional detail below. The ceiling trim 24 includes a collar 86 embodied as an annular wall extending vertically between a lower end 88 and an upper end 90, and a trim lip 92 connected with the lower end 88 of the collar 86 and extending laterally outward therefrom. The upper end 90 of the collar 86 defines a collar opening 94 and is configured to extend through the inlet 32 of the main housing 14 to communicate air drawn from the room through the ceiling aperture A into the main housing 14 (when the moveable trim 20 does not block or limit air entry).

Figure 6:
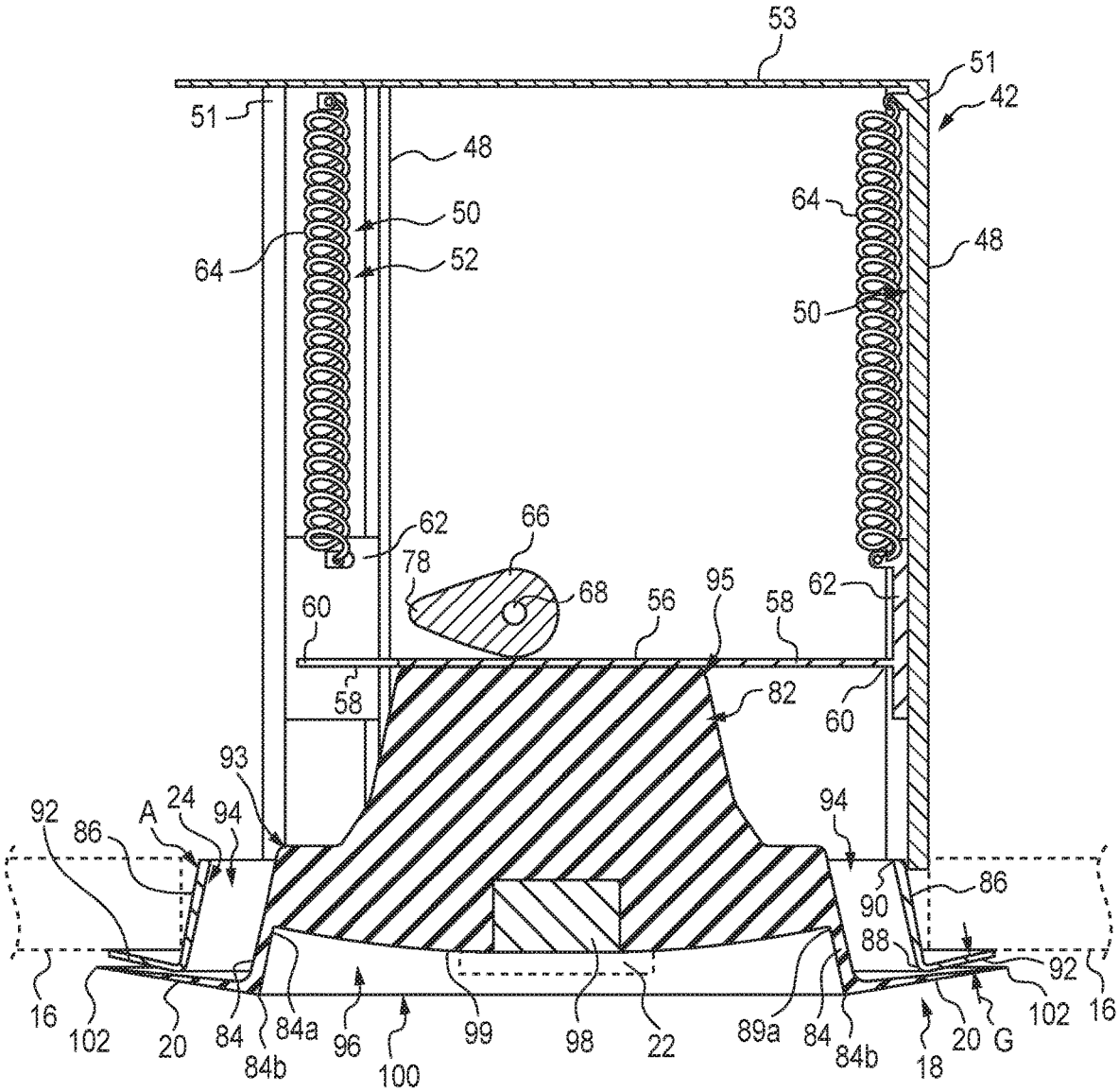
FIG. 6 is a cross-sectional view of the portion of the ventilation assembly of FIG. 4 taken along the line 6-6.

As shown in FIG. 6, the canister housing 82 forms a frusto-cone-shaped housing that includes a tapered lower portion 93 with an upper portion 95 extending vertically from a top end of the lower portion 93 for engagement with the linkage plate 56. The perimeter wall 84 extends downward from the bottom end of the lower portion 93 and defines a space 96 for receiving the lighting element 22 coupled with a light connection 98 engaged with an underside 99 of the lower portion 93 for providing electrical power to the light element. The light connection 98, and thus any connected lighting element 22, is located adjacent to an upper end **84*a* of the perimeter wall 84. The space 96 includes an opening 100 defined at a lower end 84*b* of the perimeter wall 84, the opening 100 allowing light from the light element to project out from the space 96 into the room. The moveable trim 20 extends laterally outward from the lower end 84*b* of the perimeter wall 84, circumferentially about the opening 100, to a free end 102**.

In the retracted position of the trim assembly 18 as shown in FIGS. 5 and 6, the moveable trim 20 and the ceiling trim 24 are in contact with each other such that the gap G is essentially zero, although in some embodiments, in the retracted position, the moveable trim 20 and the ceiling trim 24 may be closely spaced apart from each other to define a small gap G. The moveable trim 20 and the ceiling trim 24 illustratively overlap each other along the lateral direction of extension from their respective perimeter wall 84 and collar 86. In the retracted position of the trim assembly 18 as shown in FIG. 6, the moveable trim 20 generally, but not necessarily, conceals the ceiling trim 24 from view from underneath. Although the moveable trim 20 and the ceiling trim 24 are described as extending laterally from their respective perimeter wall 84 and collar 86, one or both may be angled slightly upward from horizontal to disguise imperfect engagement of the moveable trim 20 with the ceiling trim 24 when the trim assembly 18 is in the retracted position, and/or of the ceiling trim 24 with the surface of the ceiling 16 when installed in the aperture A. The ceiling 16 is illustratively shown in broken line in FIG. 6 to define the aperture A, and may be formed of wallboard or any suitable wall covering material.

Figure 7:
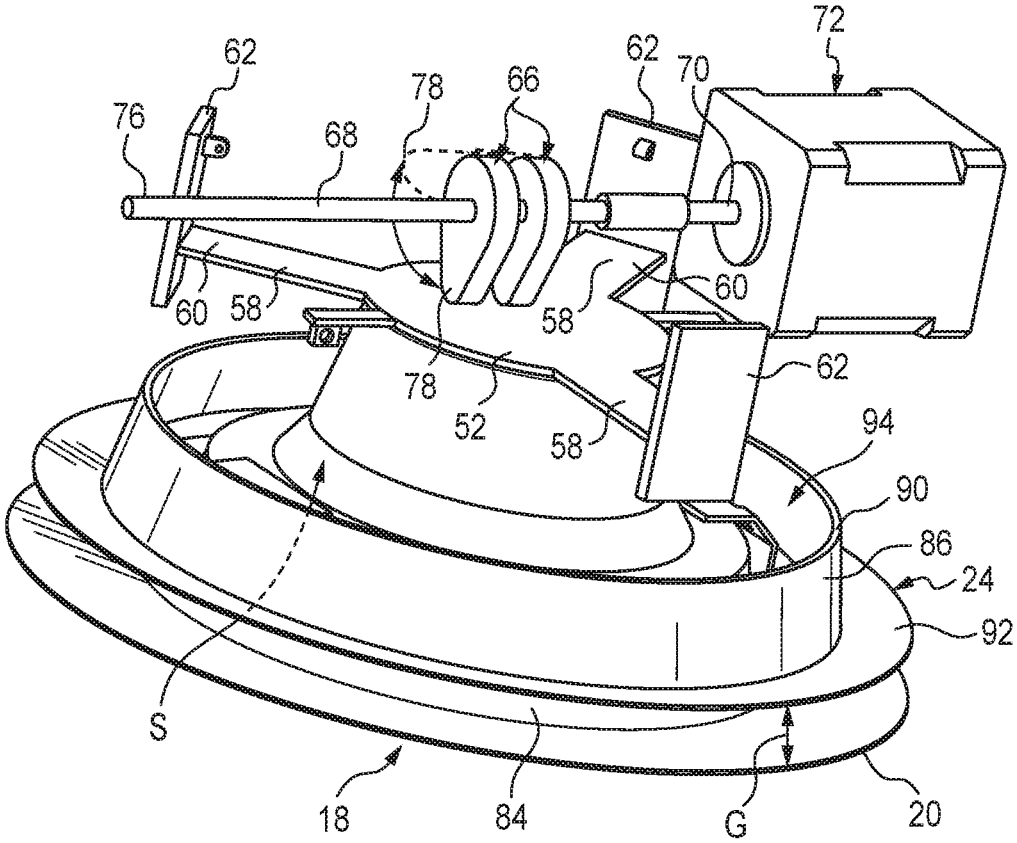
FIG. 7 is a perspective view of the portion of the ventilation assembly of FIG. 5 showing the baffle assembly arranged in an extended position.
Figure 8:
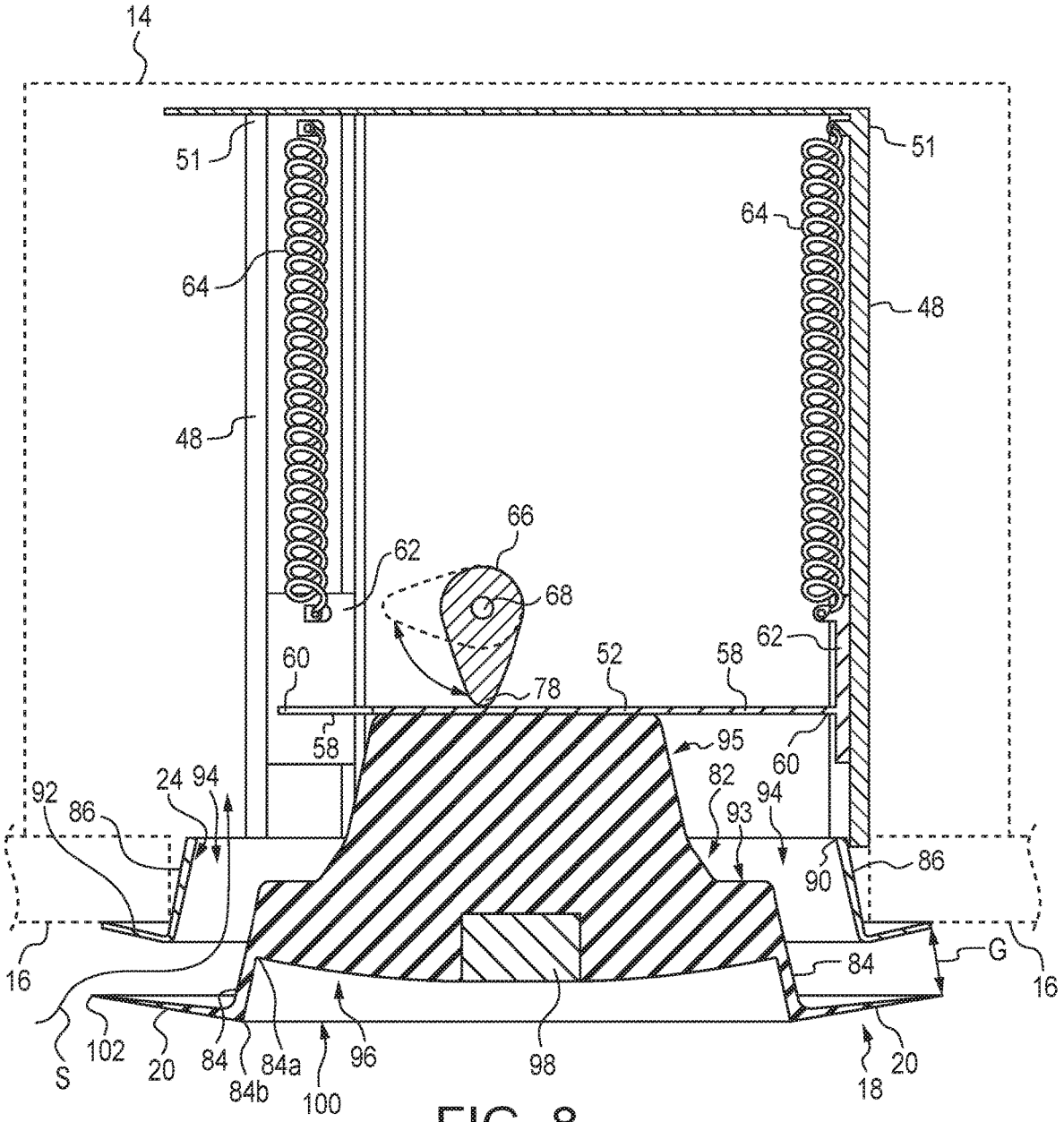
FIG. 8 is the cross-sectional view of the portion of the ventilation assembly of FIG. 6 taken along the line 6-6, but showing the baffle assembly arranged in the extended position.

Referring now to FIGS. 7 and 8, the actuator 70 has rotated the actuator shaft 68 to drive the cams 66 into the extend position (as shown in solid line in FIGS. 7 and 8) from the retract position (shown in broken line in FIGS. 7 and 8) to move the baffle assembly 18 into the extended position to define the gap G between the moveable trim 20 and the ceiling trim 24. In the extend position, the noses 78 of the cams 66 engage the linkage plate 56 to drive the linkage 46 downward relative to the retracted position. In the illustrative embodiment, the ceiling trim 24 is secured with the ceiling 16 (shown in FIG. 8, but omitted for descriptive ease in FIG. 7), such that the ceiling trim 24 remains stationary relative to the moveable trim 20 which moves downward as the trim assembly 18 moves to the extended position.

Referring to FIG. 8, in the extended position the gap G is open to define a flow path for allowing fluid flow S to be drawn into the main housing 14. The fluid flow S is illustratively drawn from the room below the ceiling 16, through the gap G between the moveable trim 20 and the ceiling trim 24, between the perimeter wall 84 and the collar 86, through the collar opening 94 into the main housing 14. Rotating of the cams 66 out of from the extend position (e.g., towards the retract position as shown in broken line in FIG. 8) allows the linkage 46 to be lifted by the tension of the springs 64 to return the baffle assembly 18 to the retracted position as shown in FIGS. 5 and 6. Accordingly, by selective operation of the actuator assembly 44, the trim assembly 18 can be lowered into the extended position to open the gap G for communicating the flow path of fluid S into the main housing 14 or can be raised into the retracted position to close the gap G and to block or reduce fluid flow S into the main housing 14.

Figure 9:
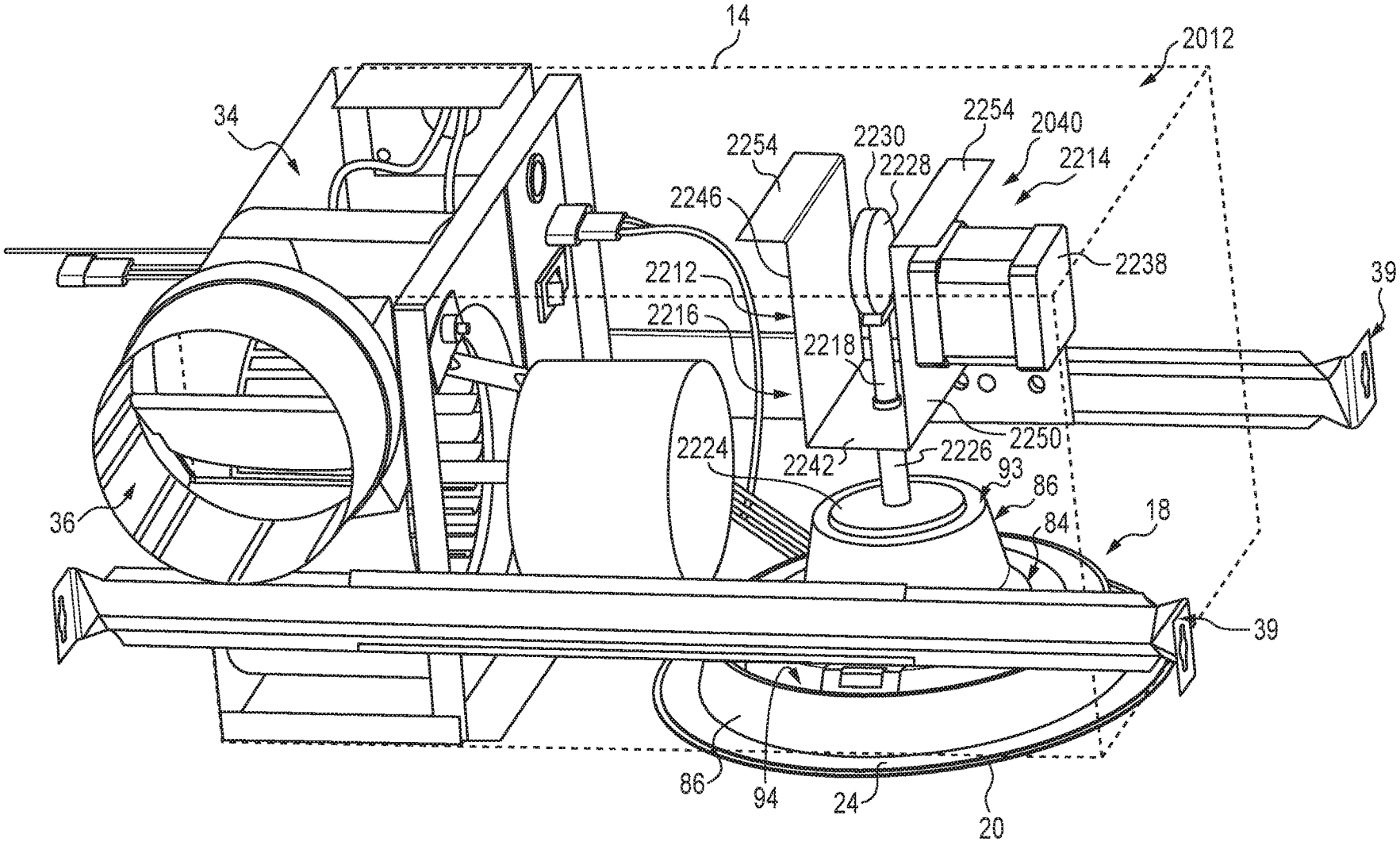
FIG. 9 is a perspective view of a ventilation assembly in accordance with a second non-restrictive illustrative embodiment thereof.

Referring now to FIG. 9, a second illustrative embodiment of a ventilation assembly 2012 is shown that is similar to the ventilation assembly 12, including moveable trim assembly 18 positionable in retracted and extended positions. The disclosure of ventilation assembly 12 applies equally to ventilation assembly 2012, except instances of conflict with the particular disclosure of ventilation assembly 2012, in which case the particular disclosure of ventilation assembly 2012 governs. For example, the ventilation assembly 2012 includes an actuation assembly 2040 engaged between the main housing 14 and the trim assembly 18 to selectively adjust the baffle assembly 18, as discussed in additional detail below, in lieu of the actuation assembly 40.

Figure 10:
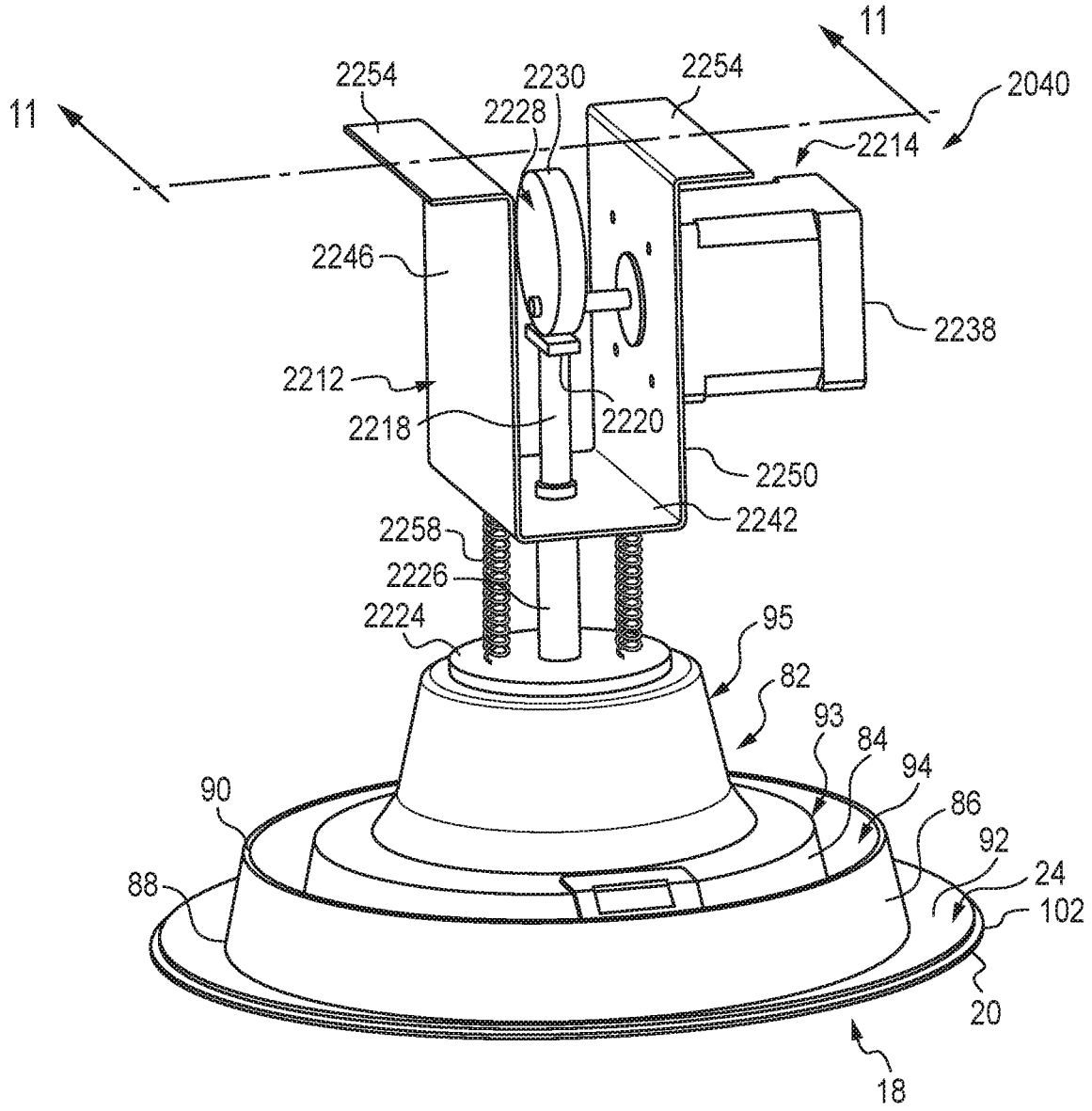
FIG. 10 is another perspective view of a portion of the ventilation assembly of FIG. 9 showing a trim assembly arranged in a closed position.

As shown in FIG. 10, the actuation assembly 2040 includes a frame 2212 for connection with the main housing 14, an actuator assembly 2214, and a movable linkage 2216 connected with the trim assembly 18 and coupled with the frame 2212 for movement under the force of the actuator assembly 2214 to adjust the trim assembly 18 between retracted and extended positions.

Figure 11:
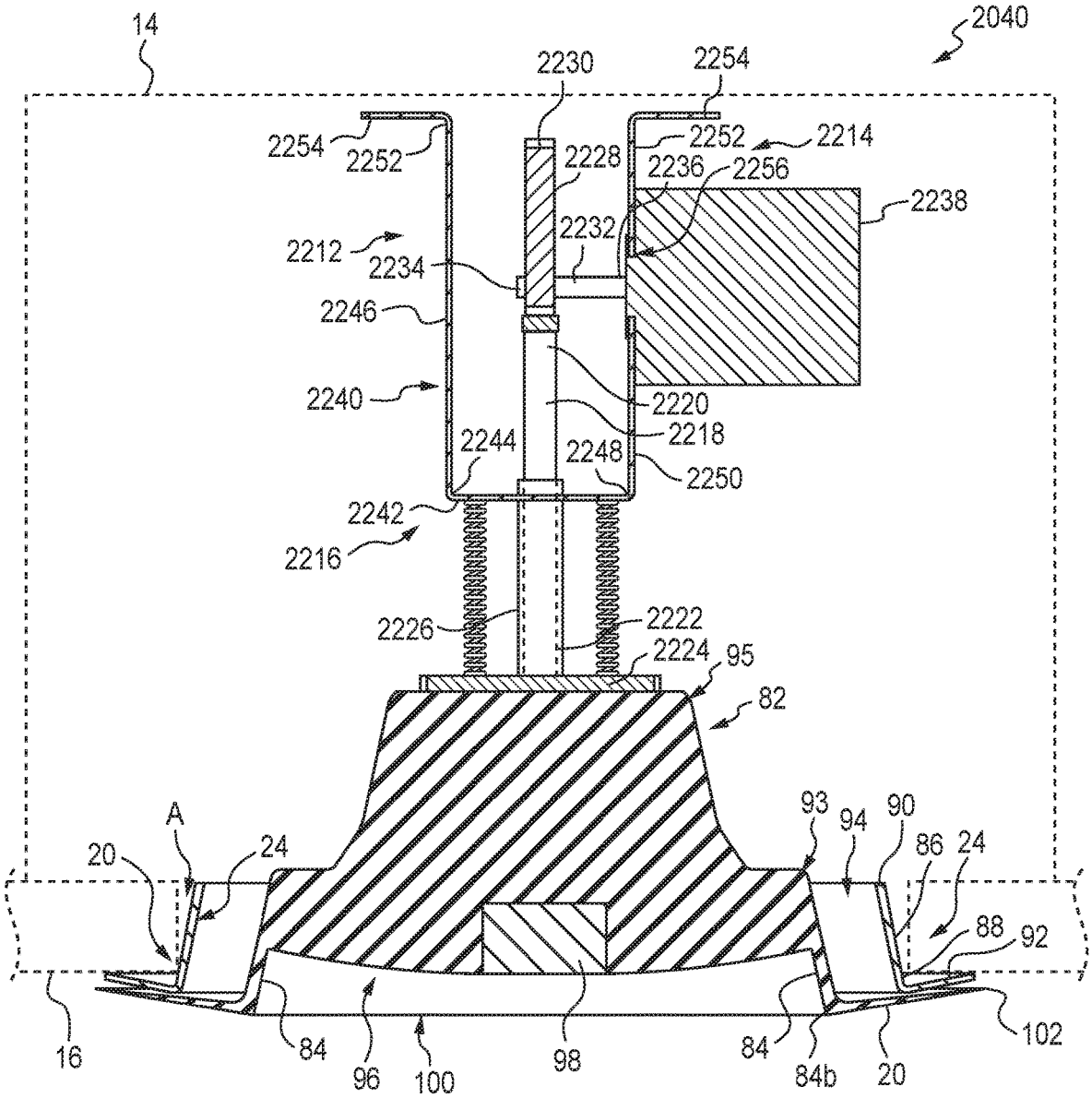
FIG. 11 is a cross-sectional view of the portion of the ventilation assembly of FIG. 10 taken along the line 11-11.

Referring to FIG. 11, the linkage 2216 includes a shaft 2218 having one end 2220 arranged for engagement with the actuator assembly 2214 and an opposite end 2222 connected with a linkage plate 2224 that is engaged with the upper portion 95 of the trim assembly 18 to move the trim assembly 18 between the retracted and extended positions. The shaft 2218 extends from the end 2222 through a conduit 2226 of the frame 2212, to the end 2220 for engagement with the actuator assembly 2214.

The actuator assembly 2214 includes a cam 2228 having an eccentric nose 2230 for rotation to engage and depress the shaft 2218 to drive the shaft 2218 to extend out from the conduit 2226 to move the trim assembly 18. The cam 2228 is fixed for rotation with an actuator shaft 2232 at one end 2234. An opposite end 2236 of the actuator shaft 2232 engages with an actuator 2238 for selective rotation of the actuator shaft 2232 to rotate the cam 2228 between retract and extend positions corresponding with the retracted and extended positions of the trim assembly 18. The actuator 2238 is supported for operation by the frame 2212 and the actuator shaft 2232 connects with the actuator 2238 through an opening 2256 in the frame.

The frame 2212 illustratively includes a bracket 2240 formed with a U-shape, including a bottom wall 2242 through which the shaft 2218 of the linkage extends for movement. A first end 2244 of the bottom wall 2242 is connected with a side wall 2246 and an opposite end 2248 of the bottom wall 2242 is connected with another side wall 2250. Each side wall 2246, 2250 extends from connection with the bottom wall 2242 to a support end 2252. The support end 2252 of each side wall 2246, 2250 is connected with a support flange 2254 for securement with a roof of the main housing 14. The side wall 2250 includes the opening 2256 for receiving a portion of the actuator 2238.

The conduit 2226 is formed as a portion of the frame 2212 fixed with the bottom wall 2242 to extend partially therethrough. The conduit 2226 is formed as a hollow tube defining a passage through the bottom wall 2242 for movably receiving and guiding the shaft 2218 to transfer movement of the cam 2228 into movement of the trim assembly 18. As shown in FIGS. 10 and 11, the cam 2228 is positioned such that the nose 2230 is out of engagement with the shaft 2218 such that springs 2258 connected on either of their ends with the linkage plate 2224 and the bottom wall 2242 bias the linkage 2216 upward and the trim assembly 18 into the retracted position. In some embodiments, the springs 2258 may be arranged in any suitable manner to bias the linkage 2216 against the force of the cam 2228.

Figure 12:
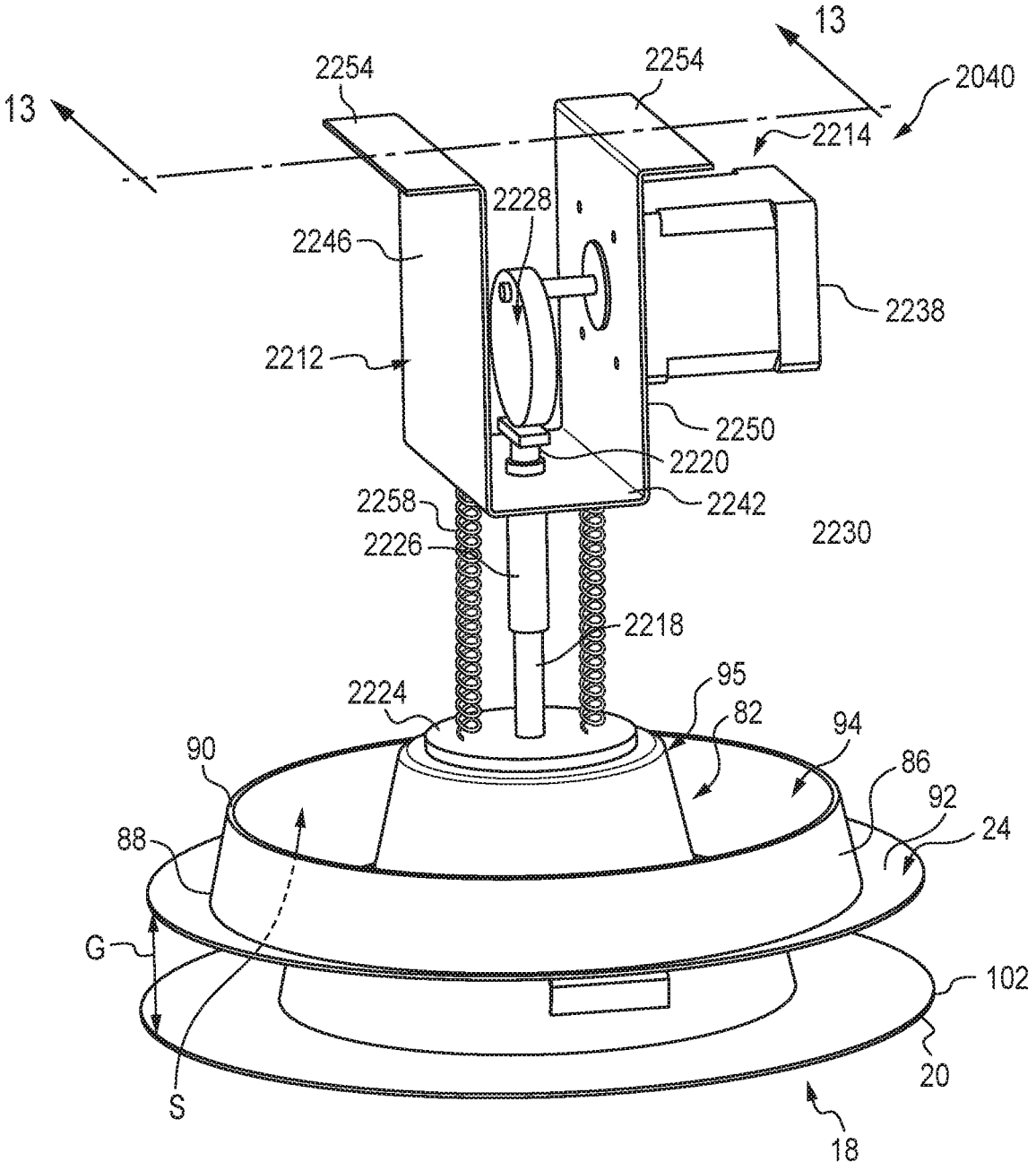
FIG. 12 is the perspective view of the portion of the ventilation assembly of FIG. 10 showing the baffle assembly arranged in an extended position.
Figure 13:
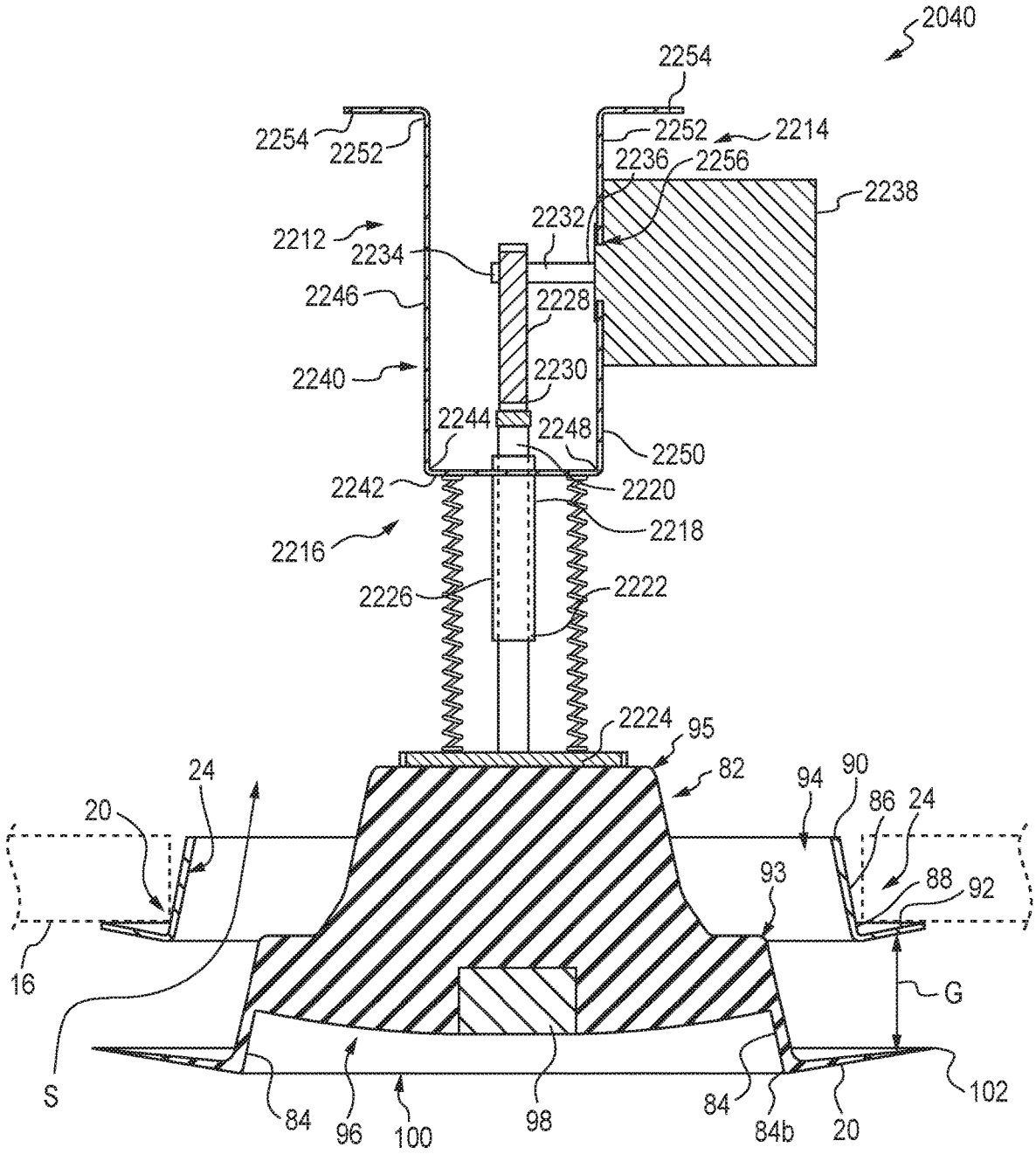
FIG. 13 is the cross-sectional view of the portion of the ventilation assembly of FIG. 12 taken along the line 13-13 showing the baffle assembly arranged in the extended position.

Referring now to FIGS. 12 and 13, the trim assembly 18 is arranged in the extended position. The actuator 2238 has rotated the cam 2228 into the extend position such that the nose 2230 engages and depresses the shaft 2218 through the conduit 2226 to drive the trim assembly 18 downward into the extended position. In the extended position, the gap G is defined between the moveable trim 20 and the ceiling trim 24 to define a flow path for allowing fluid flow S to be drawn into the main housing 14. Rotating of the cam 2228 out of from the extend position allows the linkage 2216 to be lifted by the biasing force of the springs 2258 to return the trim assembly 18 to the retracted position as shown in FIGS. 10 and 11. Accordingly, by selective operation of the actuator assembly 2214, the trim assembly 18 can be lowered into the extended position to open the gap G for communicating the flow path of fluid S into the main housing 14 or can be raised into the retracted position to reduce or remove the gap G and to block against flow of fluid S into the main housing 14.

Figure 14:
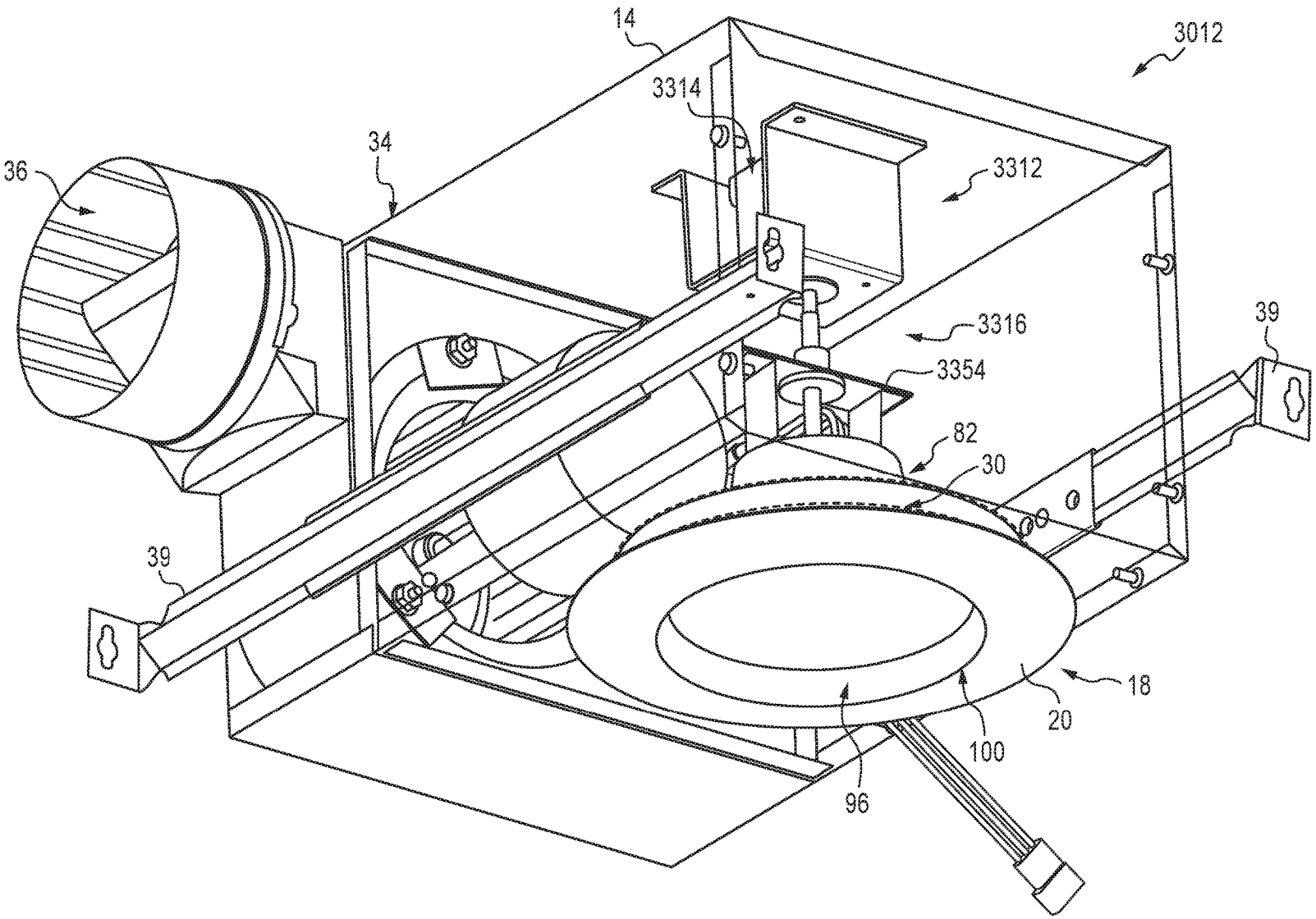
FIG. 14 is a perspective view of a ventilation assembly in accordance with a third non-restrictive illustrative embodiment thereof.

Referring now to FIG. 14, a third illustrative embodiment of a ventilation assembly 3012 is shown that is similar to the ventilation assemblies 12, and 2012, including moveable trim assembly 18 positionable in retracted and extended positions. The disclosure of each of the ventilation assemblies 12, 2012 applies equally to ventilation assembly 3012, except instances of conflict with the particular disclosure of ventilation assembly 3012, in which case the particular disclosure of ventilation assembly 3012 governs. For example, the ventilation assembly 3012 includes an actuation assembly 3040 engaged between the main housing 14 and the trim assembly 18 to selectively move the baffle assembly, as discussed in additional detail below, in lieu of either the actuation assembly 40 or 2040.

Figure 15:
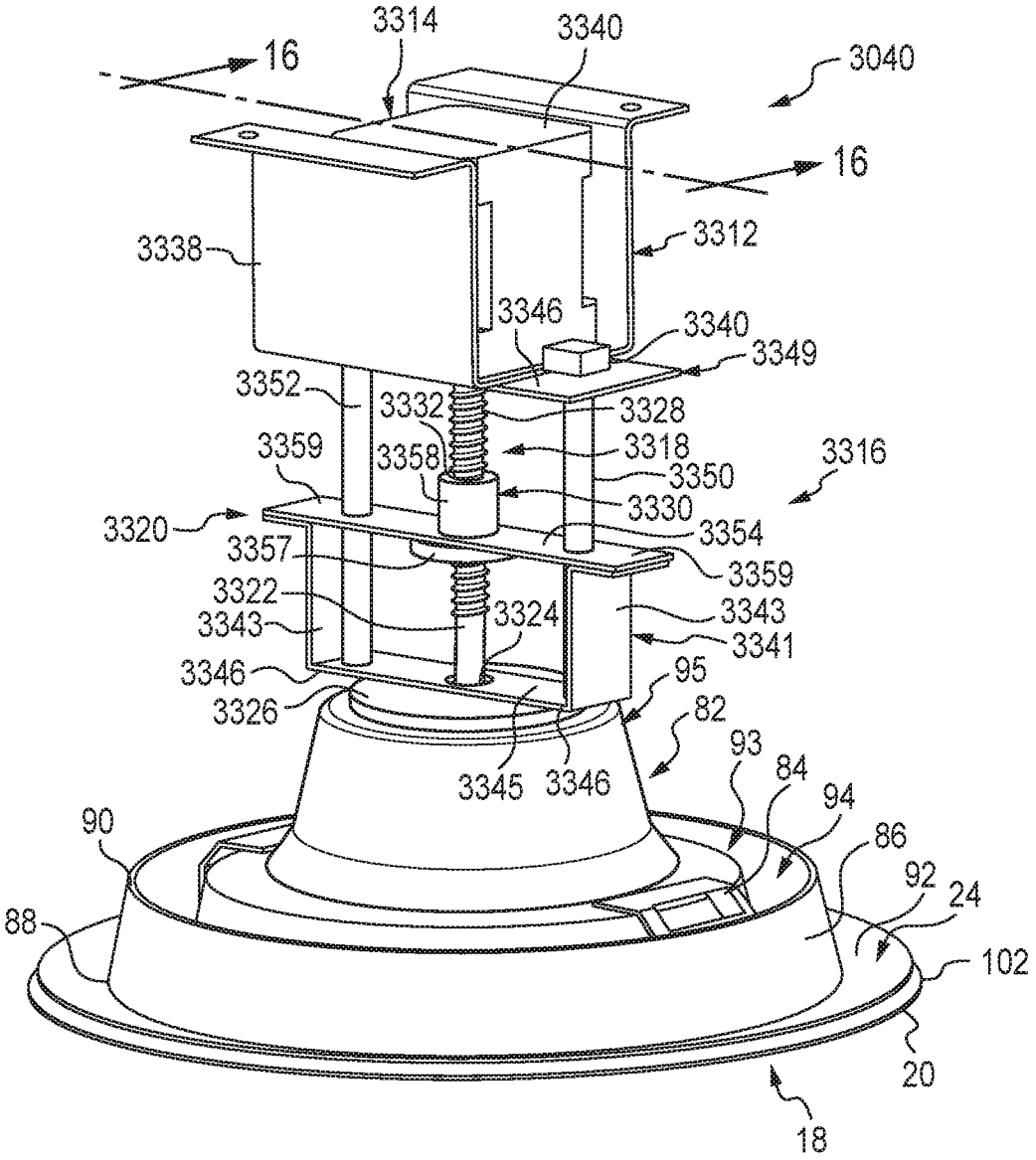
FIG. 15 is another perspective view of a portion of the ventilation assembly of FIG. 14 showing a trim assembly arranged in a closed position.
Figure 16:
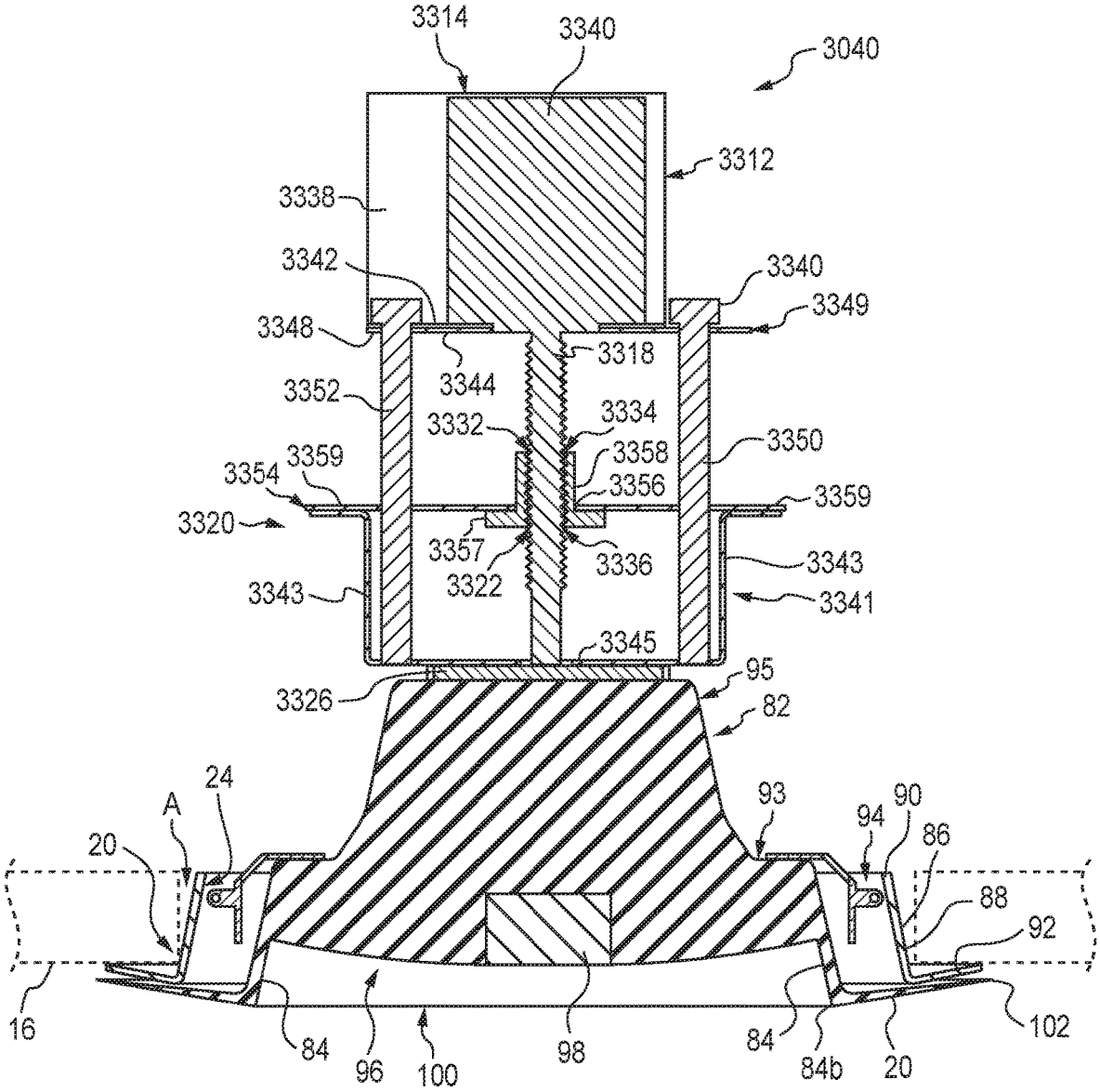
FIG. 16 is a cross-sectional view of the portion of the ventilation assembly of FIG. 15 taken along the line 16-16.

Referring to FIGS. 15 and 16, the trim assembly 18 is shown in the retracted position. The actuation assembly 3040 includes a frame 3312 for connection with the main housing 14, an actuator assembly 3314, and a movable linkage 3316 connected with the trim assembly 18 for movement under the force of the actuator assembly 3314 to arrange the trim assembly 18 between retracted and extended positions.

The actuator assembly 3314 includes a shaft 3318 and an actuator 3340. The shaft 3318 is engaged at an upper end with the actuator 3340 for driven rotation and extends downward from the actuator 3340 to an opposite end 3324 through a bushing 3330 of the linkage 3316 to transfer rotational force from the actuator 3340 to vertically drive the trim assembly 18 between retracted and extended positions. The shaft 3318 extends through the bushing 3330 with threaded engagement to transfer rotational force from the actuator 3340 into longitudinal force to move the trim assembly 18.

Referring to FIG. 16, the bushing 3330 is rotationally fixed with a bracket 3320, and includes an opening 3332 through which the shaft 3318 extends. Within the opening 3332, the bushing 3330 includes interior threads 3334 of an inner surface defining the opening 3332 formed complimentary to exterior threads 3336 of an outer surface of the shaft 3318. Under rotation in a first direction from the actuator 3340 the shaft 3318 rotates relative to the bushing 3330 in threaded engagement therewith such that the bushing 3330 is driven downward away from the actuator 3340 by the incline between the threads 3334, 3336 to move the trim assembly 18 towards the extended position.

Figure 17:
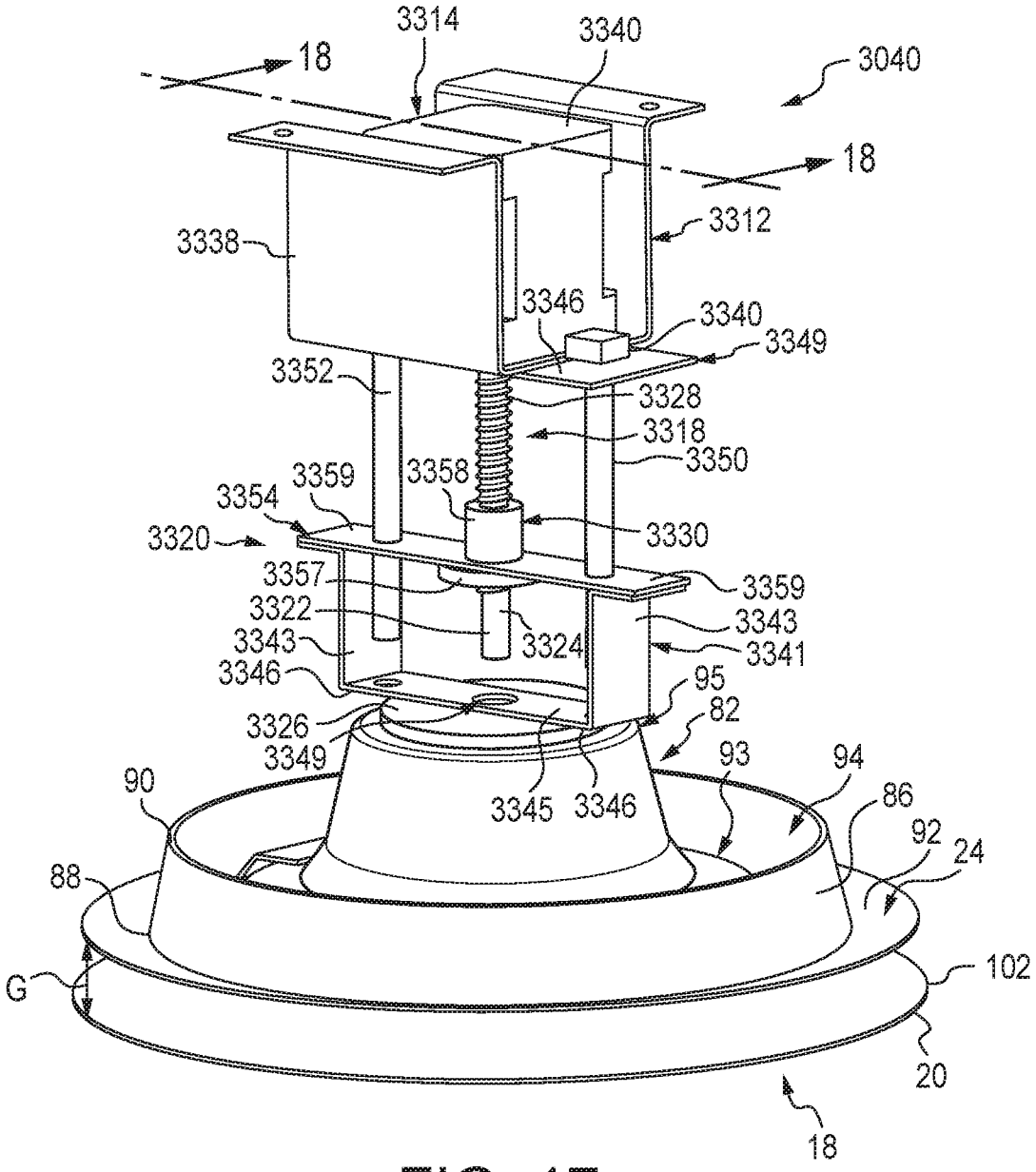
FIG. 17 is the perspective view of the portion of the ventilation assembly of FIG. 15 showing the baffle assembly arranged in an extended position.
Figure 18:
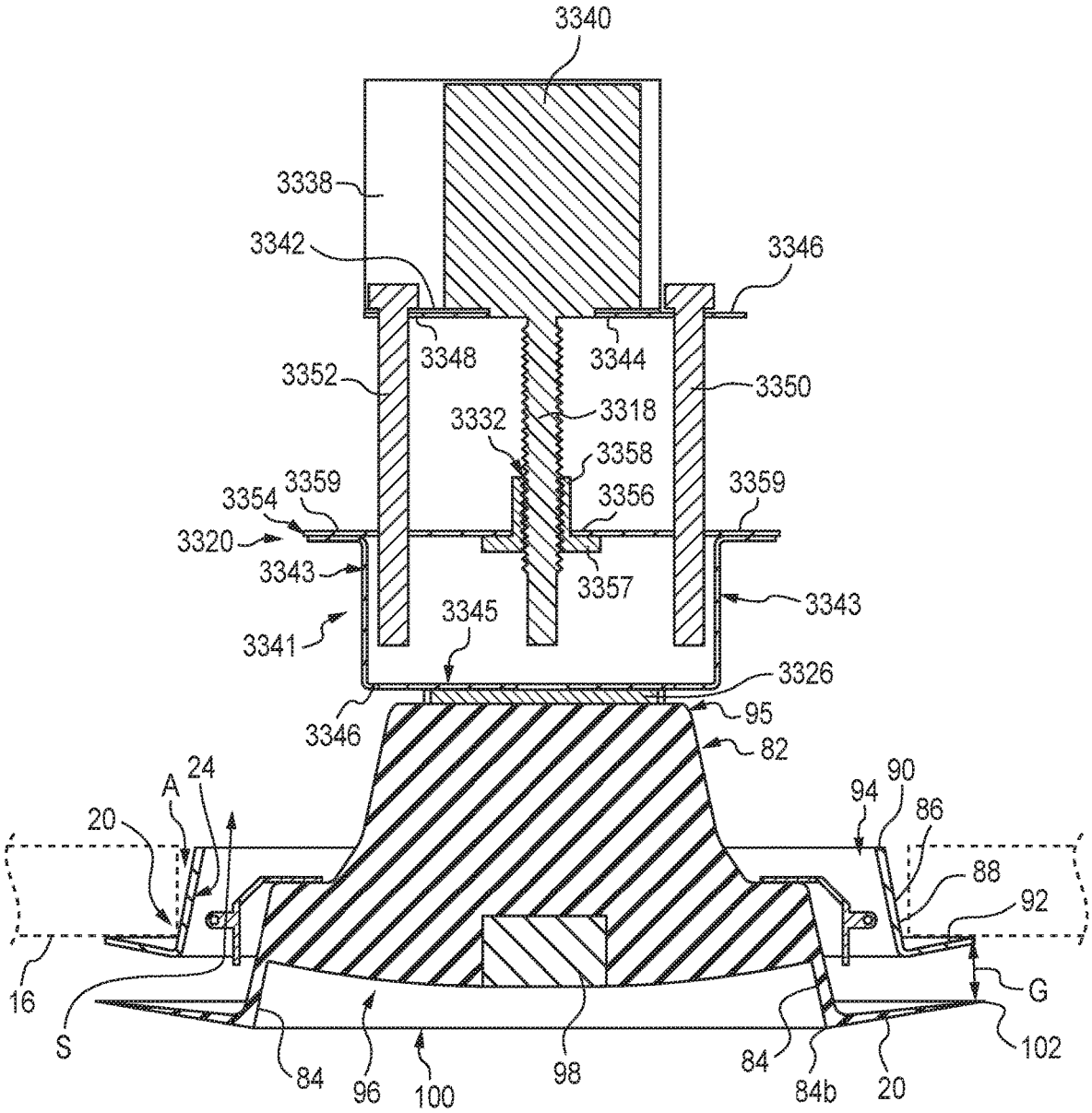
FIG. 18 is a cross-sectional view of the portion of the ventilation assembly of FIG. 17 taken along the line 18-18 showing the baffle assembly arranged in the extended position.

As shown in FIGS. 17 and 18, the actuator 3340 has rotated the shaft 3318 in a first direction such that its threaded engagement drives the bushing 3330 downward relative to shaft 3318, to lower the trim assembly 18 into the extended position. Rotation of the shaft 3318 by the actuator 3340 in a second direction opposite to the first direction drives the bushing 3330 by its threaded engagement with the shaft 3318 into the retract position to move the trim assembly 18 into the retracted position as shown in FIGS. 15 and 16.

Returning briefly to FIG. 15, the frame 3312 illustratively includes a bracket 3338 formed similar to bracket 2240, and connectable with the main housing 14 for support. However, instead of a side mounted actuator, the actuator 3340 is arranged within the U-shaped formed by the bracket 3338. The shaft 3318 extends through a bottom wall 3342 of the bracket 3338 to connect with the actuator 3340 to receive driven rotation.

Returning now to FIG. 16, the frame 3312 illustratively includes an extension bracket 3344 connected to an under side of the bottom wall 3342 of the bracket 3338. The extension bracket 3344 includes ends 3346, 3348 extending on opposite sides of the actuator 3340. The frame 3312 includes rods 3350, 3352, including rod 3350 extending through the end 3346 of the extension bracket 3344, and rod 3352 extending through the end 3348 of the extension bracket 3344. The rods 3350, 3352 each extend down from the extension bracket 3344 and remain stationary to provide guiding engagement with a bushing bracket 3354 which supports the bushing 3330 during movement to transfer force from the actuator 3340 to the trim assembly 18.

The bushing bracket 3354 includes a center portion 3356 that connects with the bushing 3330, and opposite end portions 3359 each receiving one of the rods 3350, 3352 therethrough. Under vertical force of the bushing 3330, the bushing bracket 3354 moves to transfer force of the actuator 3340 to the trim assembly 18. The rods 3350, 3352 prevent rotation of the bushing bracket 3354 and the bushing 3330 under rotation of the shaft 3318 to allow the threaded engagement between the bushing 3330 and the shaft 3318 to convert rotational force into translational movement for the trim assembly 18.

The bushing 3330 is rotationally and translationally fixed with the bushing bracket 3354. The bushing 3330 includes a base 3357 and a hub 3358 projecting from the base 3357 through an opening in the center portion 3356 of the bushing bracket 3354. The hub 3358 and the base 3357 collectively define the opening 3332 through the bushing 3330 to provide the interior threads 3334 for engagement with the shaft 3318, as mentioned above.

The rods 3350, 3352 each extend through the bracket 3354 to a lower end to extend through and guide a lower member 3341 of the bracket 3320. The lower member 3341 is formed as a U-shaped bracket having arms 3343 on opposite ends, each arm 3343 connected with one of the ends 3359 of the bushing bracket 3354. The lower member 3341 includes a bottom wall 3345 having opposite ends 3346 each connected with an end of one of the arms 3343 opposite the bushing bracket 3354, and engaging the rods 3350, 3352 for guidance. The bottom wall 3345 is connected with the linkage plate 3326 to transfer vertical motion to the trim assembly 18. The bracket 3320 thus transmits the movement of the bushing 3330 to the trim assembly 18.

Figure 19:
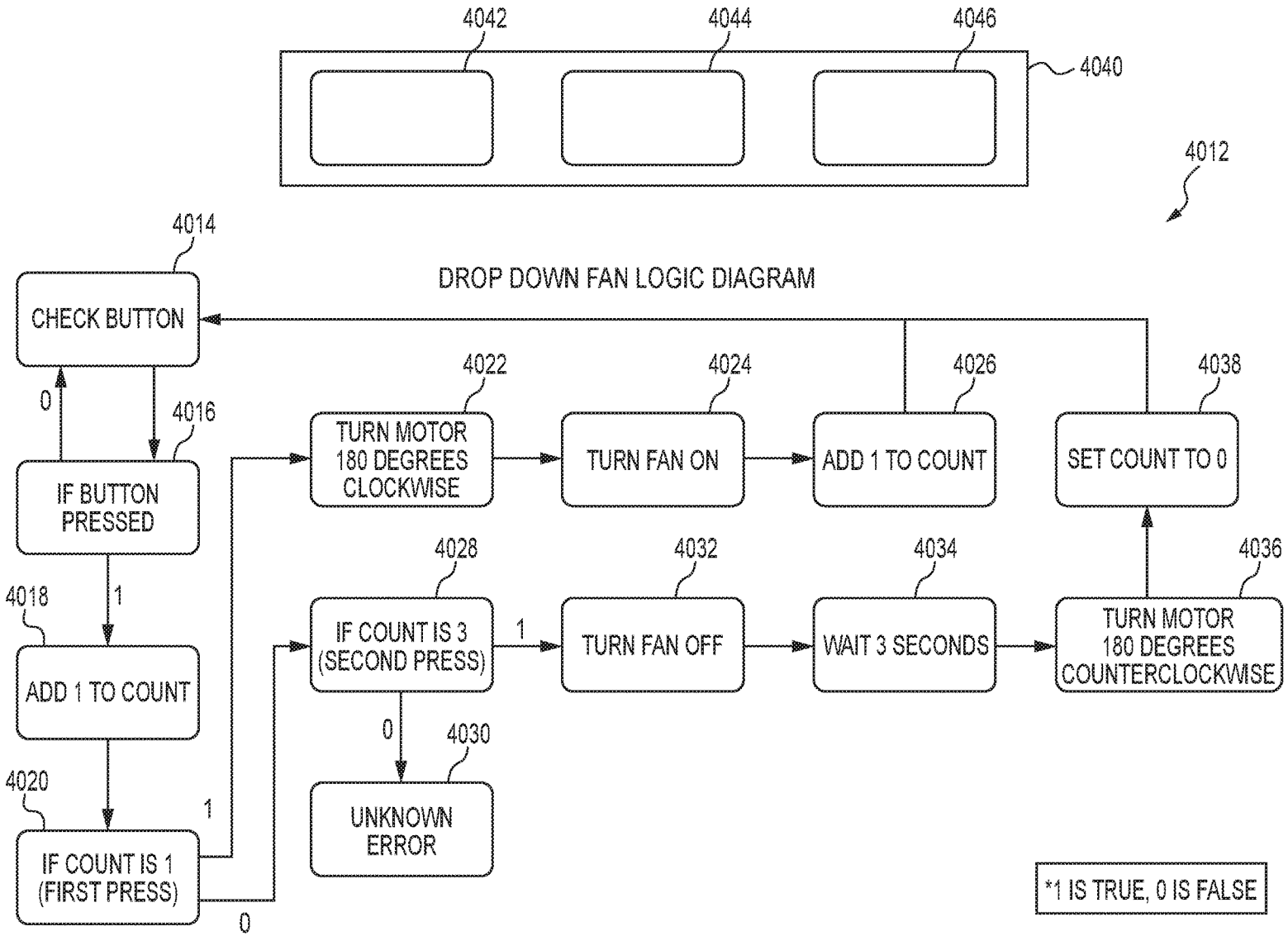
FIG. 19 is flow diagram illustrating a logical operation of a ventilation assembly in accordance with non-restrictive illustrative embodiments herein.

Referring now to FIG. 19, a process of logic operation is illustrated as logic flow 4012. In boxes 4014,4016, a check is performed to determine whether a button has been operated. In the illustrative embodiment, the button may be a user interface button for actuation of the ventilation assembly 12, 2012, 3012 between on and off operational states. If the button has been operated, the process proceeds to box 4018 which adds one digit to a count and proceeds to box 4020. At box 4020, if the count is 1 the process proceeds to box 4022.

At box 4022, the motor is operated to place the trim assembly 18 in the extended position. The motor is illustratively embodied as a rotary electric actuator, such as actuators 70, 2238, 3340, operable for rotation in a first direction by 180 degrees to a first position, and operable for rotation in a second direction, opposite to the first direction by 180 degrees to an original position. In box 4022, the motor is rotated by 180 degrees into the first position and the process proceeds to box 4024 to turn the blower 34 on to draw air into the main housing and outlet through the outlet 36. The process proceed to box 4026 to add a digit to the count and return to box 4014.

At box 4022, if the count is not zero, the process proceeds to box 4028 to determine if the count is 3 or other. If the count is other than 3, the process proceeds to box 4030 to determine an error has occurred. If the count is 3, the process proceeds to box 4032 to turn off the blower 34 and to proceed to box 4034 to pause for three seconds. The process proceeds to box 4036 to rotate the motor in the second direction to the original position to place the trim assembly 18 in the retracted position, and to proceed to box 4038 to set the counter to zero and return to box 4014. Accordingly, coordinated operation of the blower and trim assembly can be effected.

Still referring to FIG. 19, a controller 4040 is shown for guiding operation of the ventilation assembly 12, 2012, 3012. The controller 4040 includes a processor 4042 for executing instructions stored on a memory 4044 to generate commands for communication to portions of the ventilation assembly 12, 2012, 3012 via communication circuitry 4046. The instructions stored on the memory 4044 include the logic flow, and commands to operate the blower 34 and the motor/actuator are communicated via the communication circuitry 4046. The processor 4042 may include any suitable processing device, such as an integrated circuit and/or minimal instruction set computer (MISC) and the memory may include any suitable memory device, such as RAM, ROM, and/or flash memory. The controller 4040 illustratively performs the operations as described regarding the logic flow 4012 to guide operation of the blower 34 and trim assembly 18.

It should be noted that the various components and features described above can be combined in a variety of ways, so as to provide other non-illustrated embodiments within the scope of the disclosure. As such, it is to be understood that the disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation.

Although the present disclosure has been described in the foregoing description by way of illustrative embodiments thereof, these embodiments can be modified at will, without departing from the spirit, scope, and nature of the subject disclosed.

We claim:

1. A ventilation assembly comprising:

a main housing including an inlet through which air can be received into the main housing and an outlet through which air exits the main housing;

a blower situated in the main housing and operable to generate a flow of air;

a trim assembly coupled with the main housing and comprising a moveable trim, the trim assembly being movable between a retracted position in which the moveable trim is adjacent the main housing to limit fluid flow through the main housing inlet and an extended position in which the moveable trim is farther from the main housing than in the retracted position to define a gap allowing air to flow through the main housing inlet; and a user interface configured to select one of an on operational state and an off operational state, wherein activation of the on operational state places the moveable trim in the extended position and turns the blower on, and activation of the off operational state places the moveable trim in the retracted position and turns the blower off.

2. The ventilation assembly of claim 1, wherein the main housing includes a ceiling trim, wherein in the retracted position the moveable trim is positioned near to the ceiling trim and in the extended position the moveable trim is positioned spaced apart from the ceiling trim to define a gap through which air can be drawn into the inlet of the main housing.

3. The ventilation assembly of claim 1, wherein the trim assembly includes a baffle wall connected with the moveable trim for movement between the retracted and extended positions.

4. The ventilation assembly of claim 3, wherein the baffle wall forms a canister housing for receiving a lighting element for illumination.

5. The ventilation assembly of claim 4, wherein the canister housing is formed as a frusto coned-shaped housing defining a space therein for receiving the lighting element, the canister housing defining an opening that faces away from the main housing for guiding illumination into a room.

6. The ventilation assembly of claim 1, further comprising a linkage coupled between a frame secured with the main housing and the trim assembly, the linkage configured to transmit force from an actuator to move the trim assembly in at least one direction between the retracted and extended positions.

7. The ventilation assembly of claim 6, wherein the frame includes at least one brace coupled with the main housing and configured to guide the trim assembly between the retracted and extended positions.

8. The ventilation assembly of claim 7, wherein the at least one brace defines a track and the linkage includes a follower arranged within the track and coupled with the trim assembly to guide the moveable trim between the retracted and extended positions.

9. The ventilation assembly of claim 7, wherein the linkage includes at least one guide rod coupled with the at least one brace and coupled with the trim assembly to guide the trim assembly between the retracted and extended positions.

10. The ventilation assembly of claim 6, wherein the linkage includes at least one of a cam and an inclined plane for operation by the actuator to move the moveable trim.

11. The ventilation assembly of claim 1, further comprising an actuator configured to provide force to move the trim.

12. The ventilation assembly of claim 1, further comprising at least one spring for biasing the trim assembly in a direction of one of the retracted and extended positions.

13. The ventilation assembly of claim 1, wherein the main housing is configured for arrangement within an unfinished area of a room, and the moveable trim is configured for arrangement in a finished area of the room that is separated from the unfinished area of the room.

14. The ventilation assembly of claim 1, wherein the trim assembly comprising a perimeter wall extending from an upper end and a lower end.

15. The ventilation assembly of claim 14, the trim assembly further comprising a lighting element located adjacent to a perimeter wall upper end and operable to generate light toward and through the perimeter wall lower end.

16. The ventilation assembly of claim 14, wherein the moveable trim extends from the perimeter wall lower end.

17. The ventilation assembly of claim 1, wherein the trim assembly is configured to be located in an aperture in a ceiling such that the moveable trim is located adjacent the ceiling in retracted position and spaced from the ceiling in the extended position.

18. The ventilation assembly of claim 1, wherein the trim assembly is configured to be located in an aperture in a ceiling, wherein space is left between the trim assembly and the ceiling aperture when the trim assembly is in the extended position and the blower is operable to draw air through the ceiling aperture.

19. The ventilation assembly of claim 1, wherein the trim assembly is configured to be located in an aperture in a ceiling and the moveable trim is located adjacent the ceiling in the retracted position to limit or prohibit movement of air through the ceiling aperture.

20. The ventilation assembly of claim 19, further comprising a ceiling trim arranged at an edge of the ceiling aperture.

21. The ventilation assembly of claim 1, wherein the blower is not operable to generate a flow of air when the trim assembly is in the retracted position.

22. A ventilation assembly comprising:

a main housing including an inlet through which air can be received into the main housing and an outlet through which air exits the main housing;

a blower situated in the main housing and operable to generate a flow of air;

a moveable trim movable between a retracted position in which the moveable trim is adjacent the main housing and an extended position in which the moveable trim is farther from the main housing than in the retracted position to define a gap permitting fluid flow into the main housing; and a user interface configured to select one of an on operational state and an off operational state, wherein activation of the on operational state comprises the moveable trim being in the extended position and the blower being on, and activation of the off operational state comprises the moveable trim being in the retracted position and the blower being off.

23. The ventilation assembly of claim 22, wherein the blower is not operable to generate a flow of air when the trim assembly is in the retracted position.

24. A ventilation assembly configured to be installed in a ceiling of a structure, the ventilation assembly comprising:

a main housing including an inlet through which air can be received into the main housing and an outlet through which air exits the main housing;

a blower situated in the main housing and operable to generate a flow of air;

a ceiling trim configured to be located in an aperture in the ceiling;

a moveable trim movable between a retracted position in which the moveable trim is adjacent to the ceiling trim to limit fluid flow through the ceiling aperture, and an extended position in which the moveable trim is spaced farther from the main housing than in the retracted position to define a gap allowing fluid to flow through the ceiling aperture; and a user interface configured to select one of an on operational state and an off operational state, wherein activation of the on operational state places the moveable trim in the extended position and turns the blower on, and activation of the off operational state places the moveable trim in the retracted position and turns the blower off.

25. The ventilation assembly of claim 24, wherein the blower is not operable to generate a flow of air when the trim assembly is in the retracted position.

* * * * *